US010204469B2

(12) United States Patent
Yokawa

(10) Patent No.: US 10,204,469 B2
(45) Date of Patent: Feb. 12, 2019

(54) BANKNOTE PROCESSING DEVICE

(71) Applicant: GLORY LTD., Himeji-shi, Hyogo (JP)

(72) Inventor: Takeshi Yokawa, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/527,576

(22) PCT Filed: Nov. 10, 2015

(86) PCT No.: PCT/JP2015/005604

§ 371 (c)(1),
(2) Date: May 17, 2017

(87) PCT Pub. No.: WO2016/079947

PCT Pub. Date: May 26, 2016

(65) Prior Publication Data

US 2017/0337764 A1 Nov. 23, 2017

(30) Foreign Application Priority Data

Nov. 18, 2014 (JP) ..... 2014-233952

(51) Int. Cl.
*G07D 11/00* (2006.01)
*G07F 19/00* (2006.01)

(52) U.S. Cl.
CPC ..... *G07D 11/0063* (2013.01); *G07D 11/0018* (2013.01); *G07D 11/0021* (2013.01); *G07D 11/0048* (2013.01); *G07D 11/0081* (2013.01); *G07F 19/20* (2013.01); *G07F 19/205* (2013.01)

(58) Field of Classification Search
CPC ..... G07D 11/0018; G07D 11/0021; G07D 11/0048; G07D 11/0063; G07D 11/0033; G07D 11/0054; G07D 11/0057; G07D 11/006; G07D 11/0081; G07D 2211/00; G07F 7/04; G07F 19/202; G07F 19/203
See application file for complete search history.

(56) References Cited

U.S. PATENT DOCUMENTS 4,479,049 A * 10/1984 Hirose ..... G07D 11/0081 194/206
2002/0074709 A1 6/2002 Kanagawa
2002/0092727 A1 7/2002 Kato
(Continued)

FOREIGN PATENT DOCUMENTS

JP 6-119526 A 4/1994

*Primary Examiner* — Mark J Beauchaine
(74) *Attorney, Agent, or Firm* — Renner, Kenner, Greive, Bobak, Taylor & Weber

(57) ABSTRACT

A banknote handling apparatus (banknote depositing/dispensing apparatus 1) includes a transport unit (41), a storage unit (3), an upper housing (111) configured to house the transport unit, and a lower housing (protective housing 131) configured to house the storage unit. The upper housing has an opening (1111) which is formed through a surface thereof on one side in a horizontal direction, and the transport unit is configured to be drawn out of the upper housing toward the one side in the horizontal direction through the opening. The lower housing has an opening (1311) which is formed through a surface thereof on the other side in the horizontal direction, and is configured to be drawn out of the lower housing toward the other side in the horizontal direction through the opening.

4 Claims, 13 Drawing Sheets

(56) References Cited

U.S. PATENT DOCUMENTS

| | | | | |
|---|---|---|---|---|
| 2013/0247799 | A1 | 9/2013 | Furuichi | |
| 2014/0027241 | A1 | 1/2014 | Sakamoto | |
| 2015/0307306 | A1* | 10/2015 | Kadota | G07D 11/00 271/3.19 |
| 2015/0359359 | A1 | 12/2015 | Komatsu et al. | |
| 2016/0240031 | A1* | 8/2016 | Tosaka | G07D 11/0018 |

* cited by examiner

BANKNOTE PROCESSING DEVICE

TECHNICAL FIELD

The present disclosure relates to a banknote handling apparatus.

BACKGROUND ART

Patent Document 1 describes a banknote depositing/dispensing apparatus as an example of a banknote handling apparatus. This banknote depositing/dispensing apparatus is placed on a teller counter of a bank, for example, and is used by a teller of the bank. The banknote depositing/dispensing apparatus includes a transport unit which transports banknotes, and a storage unit which stores the banknotes. The transport unit is housed in an upper housing. The storage unit is housed in a protective housing. The protective housing is arranged under the upper housing, and protects the storage unit at a predetermined security level or higher. In this banknote depositing/dispensing apparatus, the transport unit is configured to be drawn out of the upper housing forward of the apparatus. The protective housing has an opening which is formed through its front side and can be covered or uncovered with a door. The storage unit is configured to be drawn forward of the apparatus through the opening. For example, during maintenance, such as when troubleshooting for banknote jamming is needed, the transport unit and/or the storage unit are/is drawn forward of the apparatus to allow the maintenance person to access the inside of the apparatus.

CITATION LIST

Patent Document

[Patent Document 1] Japanese Unexamined Patent Publication No. 2014-26307

SUMMARY OF THE INVENTION

Technical Problem

In the banknote depositing/dispensing apparatus described in Patent Document 1, both of the transport unit housed in the upper housing and the storage unit housed in the protective housing are configured to be drawn forward of the apparatus. Thus, the maintenance person is able to access the inside of the apparatus only through the front of the apparatus. For this reason, this banknote depositing/dispensing apparatus may have poor maintainability.

In view of the foregoing, it is therefore an object of the present disclosure to improve the maintainability of a banknote handling apparatus.

Solution to the Problem

The present disclosure relates to a banknote handling apparatus. According to an aspect of the present disclosure there is provided an apparatus includes: a transport unit configured to transport banknotes; a storage unit configured to store the banknotes; an upper housing configured to house the transport unit; and a lower housing arranged under the upper housing, configured to house the storage unit, and including a barrier. The barrier is provided between the upper and lower housings to separate the lower housing from the inside of the upper housing.

A passage is formed through the barrier to allow the transport unit and the storage unit to communicate with each other, and allow the banknotes to pass through. The upper housing has an opening which is formed through a surface thereof on one side in a horizontal direction, and the transport unit is configured to be drawn out of the upper housing toward the one side in the horizontal direction through the opening. The lower housing has an opening which is formed through a surface thereof on the other side in the horizontal direction, which is opposite from the one side in the horizontal direction, and the storage unit is configured to be drawn out of the lower housing toward the other side in the horizontal direction through the opening.

According to this configuration, the upper housing forming part of the banknote handling apparatus has an opening which is formed through a surface thereof on the one side in the horizontal direction. The transport unit housed in the upper housing can be drawn toward the one side in the horizontal direction through the opening on the one side in the horizontal direction. On the other hand, the lower housing arranged under the upper housing has an opening which is formed through a surface thereof on the other side in the horizontal direction, i.e., opposite from the opening of the upper housing. The storage unit housed in the lower housing can be drawn toward the other side in the horizontal direction through the opening on the other side in the horizontal direction. The lower housing includes a barrier which separates the lower housing from the inside of the upper housing. A passage is formed through the barrier to allow the banknotes to pass through. The passage in the barrier is accessible from both of the opening of the upper housing on the one side in the horizontal direction and the opening of the lower housing on the other side in the horizontal direction. Thus, the banknote handling apparatus of this configuration allows a bidirectional access to the passage in the barrier, thus improving maintainability of the inside of the apparatus.

Further, the banknote handling apparatus is configured such that the transport unit is drawn toward the one side in the horizontal direction, and the storage unit is also drawn toward the other side in the horizontal direction. Thus, if two different persons are performing maintenance of the transport unit and the storage unit, respectively, these units can be maintained in parallel. This shortens the amount of time required to do maintenance of the apparatus.

Moreover, if the banknote handling apparatus is placed in such a manner that a portion of the apparatus on the one side in the horizontal direction is arranged in the lobby area (where customers are present) and away from the teller counter and a portion thereof on the other side in the horizontal direction is arranged in the teller area (where no customers are present), the storage unit storing the banknotes may be drawn out of the lower housing to collect or replenish the banknotes in the teller area with security ensured, even during business hours of a financial institution. This contributes to smooth operation of the banknote handling apparatus.

The storage unit may include a plurality of storage cases arranged side by side in the horizontal direction in the lower housing, and the passage formed through the barrier may include a plurality of passages arranged side by side in the horizontal direction and associated with the respective storage cases arranged side by side in the horizontal direction.

According to this configuration, a plurality of passages are formed through the barrier inside the banknote handling apparatus and arranged side by side in the horizontal direction. In an apparatus with such a configuration, if the inside of the apparatus were accessible only from the one side of the apparatus in the horizontal direction as in a generally known banknote handling apparatus, passages located closer to the other side in the horizontal direction (passages located deeper in the apparatus than the opening on one side in the horizontal direction) would not be easily accessible.

In the banknote handling apparatus according to the present disclosure, however, the inside of the apparatus is accessible through both of the opening on the one side in the horizontal direction and the opening on the other side in the horizontal direction. Thus, even if the plurality of passages are formed through the barrier and arranged side by side in the horizontal direction, every passage is easily accessible. This improves the maintainability of the apparatus.

The lower housing may be a protective housing configured to protect the storage unit at a predetermined security level or higher, and the transport unit may include a transport path extending in the horizontal direction in the upper housing, and a plurality of branch mechanisms branched from the transport path and respectively connected to the plurality of passages in association with the respective storage cases arranged side by side in the horizontal direction.

The lower housing serving as the protective housing functions as a safe. Thus, a person needs to obtain a special authorization to access the inside of the lower housing. The upper housing is, however, not a protective housing, and a person needs to obtain no special authorization to access the inside of the upper housing.

According to the above-described configuration, the transport unit housed in the upper housing includes a transport path extending in the horizontal direction in the upper housing, and a plurality of branch mechanisms branched from the transport path and respectively connected to the plurality of passages in association with the respective storage cases arranged side by side in the horizontal direction. If a banknote has been jammed in any of the branch mechanisms, the transport unit may be drawn out of the upper housing to remove the banknote jammed in the branch mechanism without obtaining any special authorization. Since the plurality of branch mechanisms, in which the banknote tends to be jammed relatively frequently, are housed in the upper housing, the jamming of the banknote can be resolved quickly, thus improving the maintainability of the apparatus. Further, this also decreases the possibility of banknote jamming in the lower housing.

The banknote handling apparatus may further include: a controller which is configured to perform at least one of a depositing process of storing the banknotes which have entered the upper housing in a predetermined one of the plurality of storage cases via the transport unit, or a dispensing process of dispensing the banknotes fed from the predetermined one of the plurality of storage cases out of the upper housing via the transport unit. When the predetermined one of the storage cases causes a fault during the depositing or dispensing process, the controller may switch the storage case that has caused the fault to a different one of the storage cases to continue the process, while performing a recovery operation of restoring the storage case that has caused the fault.

If a storage case in a banknote handling apparatus with a generally known configuration causes a fault during the depositing or dispensing process, the ongoing process is suspended, and a recovery operation is performed to resolve the fault in the storage case. If the recovery operation has resolved the fault, the suspended process is resumed. If the recovery operation has not resolved the fault, a determination is made that an error has occurred, and the banknote handling apparatus is stopped.

In contrast, according to the above-described configuration, if the storage case causes a fault during the depositing or dispensing process, the ongoing process is not suspended, but the storage case which has caused the fault is switched to a different storage case. That is, the banknotes are stored in, or fed from, the different storage case to continue the ongoing process. As used herein, the "different storage case" refers to a storage case which allows the same process to be performed even when the storage cases have been switched from the storage case that has caused a fault. During the depositing process, the different storage case may be, for example, one of the plurality of storage cases which store the banknotes of the same denomination, or a so-called "mixed denomination" storage case which stores banknotes of multiple different denominations (able to store the banknotes of the same denomination as the banknotes deposited). During the dispensing process, the different storage case may be, for example, one of the plurality of storage cases which store the banknotes of the same denomination. Continuing the process without a pause allows the ongoing process to be finished quickly.

In parallel with the ongoing depositing or dispensing process, a recovery operation is also performed to restore the storage case that has caused a fault. Since the ongoing process continues to be performed separately, sufficient time can be spent to perform the recovery operation. This increases the possibility of resolving the fault.

The fault may occur inside the storage case, and may be resolvable through the recovery operation performed solely by the storage case.

According to this configuration, the recovery operation can be performed to resolve the fault that has occurred in the storage case, with the depositing or dispensing process continued in parallel. More specifically, the fault in this context may be, as will be described later, a stacking failure, namely, a phenomenon in which some of the banknotes are obliquely stacked on a stacking table in a storage case (a stacking storage case), thereby forming a gap between adjacent banknotes, or a phenomenon, called "bridge," in which some of the banknotes are stacked to overlap with each other just like a bridge between inner walls of the storage case. These faults may possibly occur during the depositing process. The stacking failure may be resolved by moving the stacking table up and down. The bridge may be resolved by moving the stacking table upward so that the stacked banknotes are compressed between the stacking table and the ceiling of the storage case. These actions correspond to the recovery operation. During the dispensing process, a feeding failure, namely, a phenomenon in which the banknotes fed from the stacking table are skewed or bent, may possibly occur as the fault. The feeding failure may be resolved by a retry operation of once returning the banknotes to the stacking table, and then feeding the banknotes again. This retry operation corresponds to the recovery operation performed to resolve the fault that has occurred during the dispensing process.

In a situation where the fault has been resolved through the recovery operation, the controller may enable the storage case that has recovered from the fault when a next process is performed. In a situation where the fault has not been resolved through the recovery operation, the controller may disable the storage case that has not recovered from the fault when a next process is performed.

If the fault persists even after the depositing or dispensing process is finished, the recovery operation may be continued. Repeating the recovery operation increases the possibility of resolving the fault. If the fault has been resolved through the recovery operation, the storage case that has recovered from the fault is enabled when the depositing or dispensing process is performed next.

However, if the fault has not been resolved yet through the recovery operation, the storage case that has not recovered from the fault is disabled when the depositing or dispensing process is performed next, and another storage case with no fault is used to perform the next depositing or dispensing process. This allows the banknote handling apparatus to be operated for as long a time as possible. If the fault has not been resolved even after the recovery operation is continued (e.g., even after the recovery operation is repeated a predetermined number of times), the banknote handling apparatus may be stopped based on a determination that an error has occurred. If the depositing or dispensing process is being performed when the controller is about to stop the banknote handling apparatus based on a determination that an error has occurred, the apparatus may be stopped after the ongoing process is finished.

The storage case may be a stacking storage case configured to store the banknotes in a stacked state. Inside the stacking storage case, the stacking failure, bridge, or feeding failure as described above may possibly occur. These faults or failures are easily resolved solely by the stacking storage case.

The lower housing may have a second opening which is formed through a surface thereof on the one side in the horizontal direction, and the storage unit may be configured to be drawn out of the lower housing toward the one side in the horizontal direction through the second opening as well.

According to this configuration, the lower housing has, in addition to the opening which is formed through a surface thereof on the other side in the horizontal direction, an opening which is formed through another surface thereof on the one side in the horizontal direction. Thus, the inside of the apparatus is accessible from any one of the one side in the horizontal direction or the other. This further improves the maintainability of the banknote handling apparatus.

The upper housing may have a second opening which is formed through a surface thereof on the other side in the horizontal direction, and the transport unit may be configured to be drawn out of the upper housing toward the other side in the horizontal direction through the second opening as well.

According to this configuration, the upper housing has, in addition to the opening which is formed through a surface thereof on the one side in the horizontal direction, an opening which is formed through another surface thereof on the other side in the horizontal direction. Thus, the inside of the apparatus is accessible from any one of the one side in the horizontal direction or the other. This further improves the maintainability of the banknote handling apparatus.

Advantages of the Invention

The banknote handling apparatus improves maintainability.

DESCRIPTION OF EMBODIMENTS

An embodiment of a banknote handling apparatus according to the present disclosure will now be described in detail with reference to the drawings. Note that the following description is merely an exemplary one. For example, the banknote handling apparatus is placed in a financial institution such as a bank, and performs various processes including depositing and dispensing of banknotes. In the following description, a configuration for the banknote handling apparatus will be described on the premise that the banknote handling apparatus is placed in a bank and used by customers of the bank. It should be noted that the banknote handling apparatus disclosed herein is applicable to other locations as well, not just in a financial institution.

(General Configuration of Depositing/Dispensing Apparatus)

Figure 1:
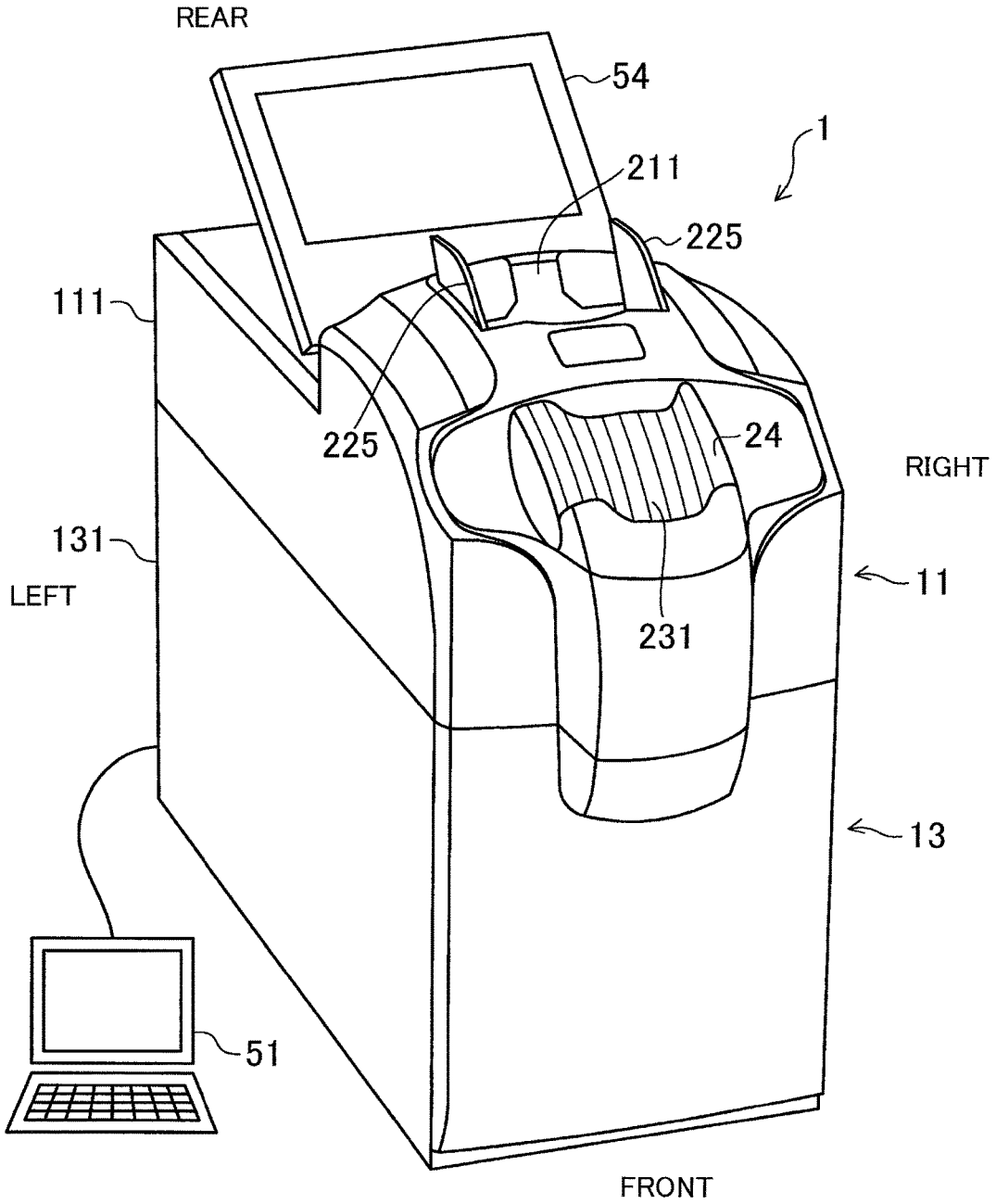
FIG. 1 is a view illustrating the appearance of a banknote depositing/dispensing apparatus.
Figure 2:
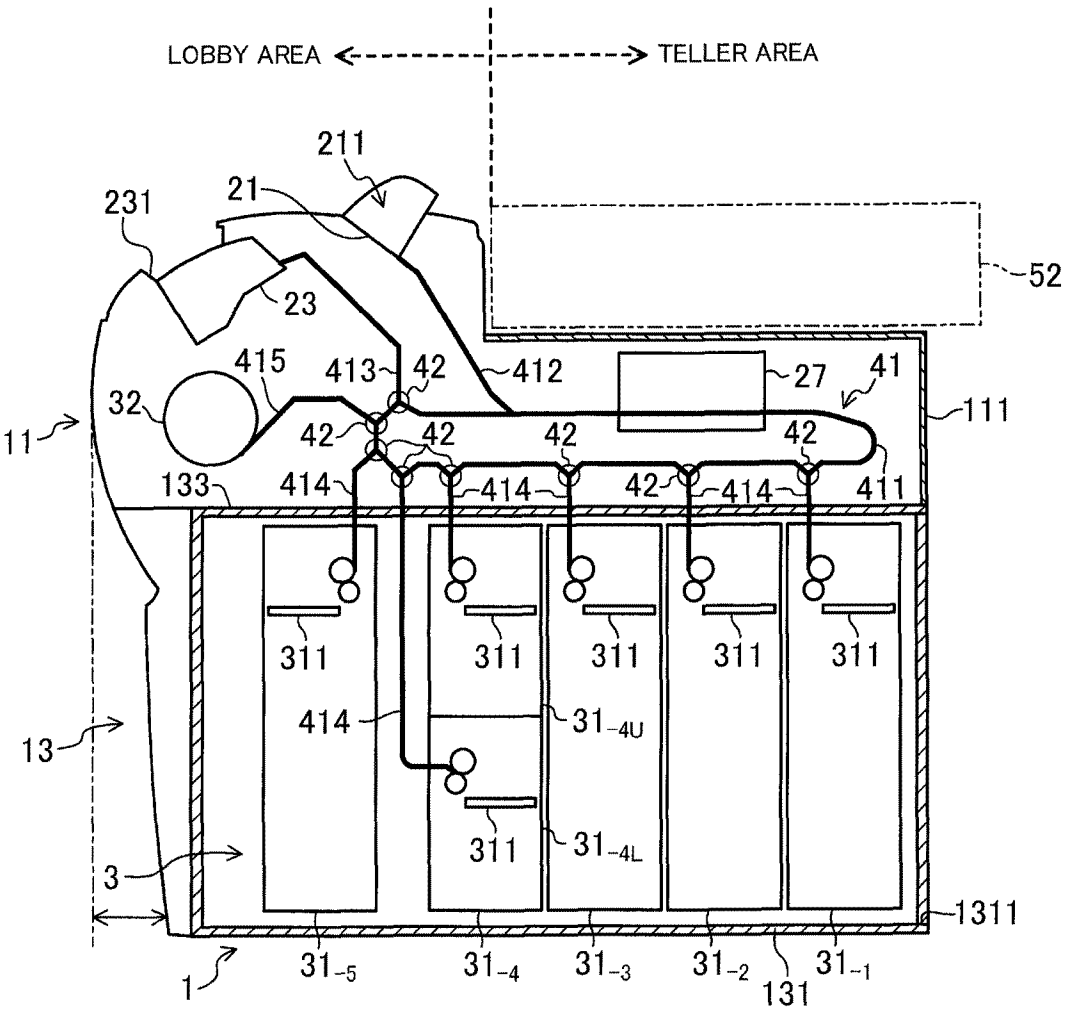
FIG. 2 is a schematic diagram illustrating an internal configuration of the banknote depositing/dispensing apparatus.

FIGS. 1 and 2 show a banknote depositing/dispensing apparatus 1 (hereinafter sometimes simply referred to as a depositing/dispensing apparatus 1). The depositing/dispensing apparatus 1 is a so-called circulating depositing/dispensing apparatus. Banknotes to be dispensed during a dispensing process include banknotes stored in a storage unit 3 during a depositing process. The depositing/dispensing apparatus 1 is connected directly, or indirectly via a network such as LAN and WAN, to a higher-ranking machine 51 so that the apparatus 1 and the machine 51 can communicate with each other.

In the following description, for ease of understanding, the side in FIG. 1 denoted FRONT will be referred to as a "front side" of the depositing/dispensing apparatus 1, the side denoted REAR in FIG. 1 a "rear side" of the depositing/dispensing apparatus 1, the side denoted LEFT in FIG. 1 a "left side" of the depositing/dispensing apparatus 1, and the side denoted RIGHT in FIG. 1 a "right side" of the depositing/dispensing apparatus 1. The depositing/dispensing apparatus 1 has a larger dimension in a lengthwise direction (i.e., a dimension measured from the front side to the rear side) than in a widthwise direction (i.e., a dimension measured from the right side to the left side). As conceptually shown in FIGS. 2 and 3, this depositing/dispensing apparatus 1 is placed in a bank, an inside space of which is divided by a counter 52 into a lobby area (where customers are present) and a teller area (where no customers are present), such that a front portion of the apparatus is located in the lobby area and that a rear portion of the apparatus is located in the teller area. The depositing/dispensing apparatus 1 has a stepped upper surface, i.e., the rear portion is one step lower than the front portion. The depositing/dispensing apparatus 1 is placed such that the counter 52 is located over the rear portion that is one step lower than the front portion. Thus, the front portion of the depositing/dispensing apparatus 1 can be almost level with the counter 52.

Figure 3:
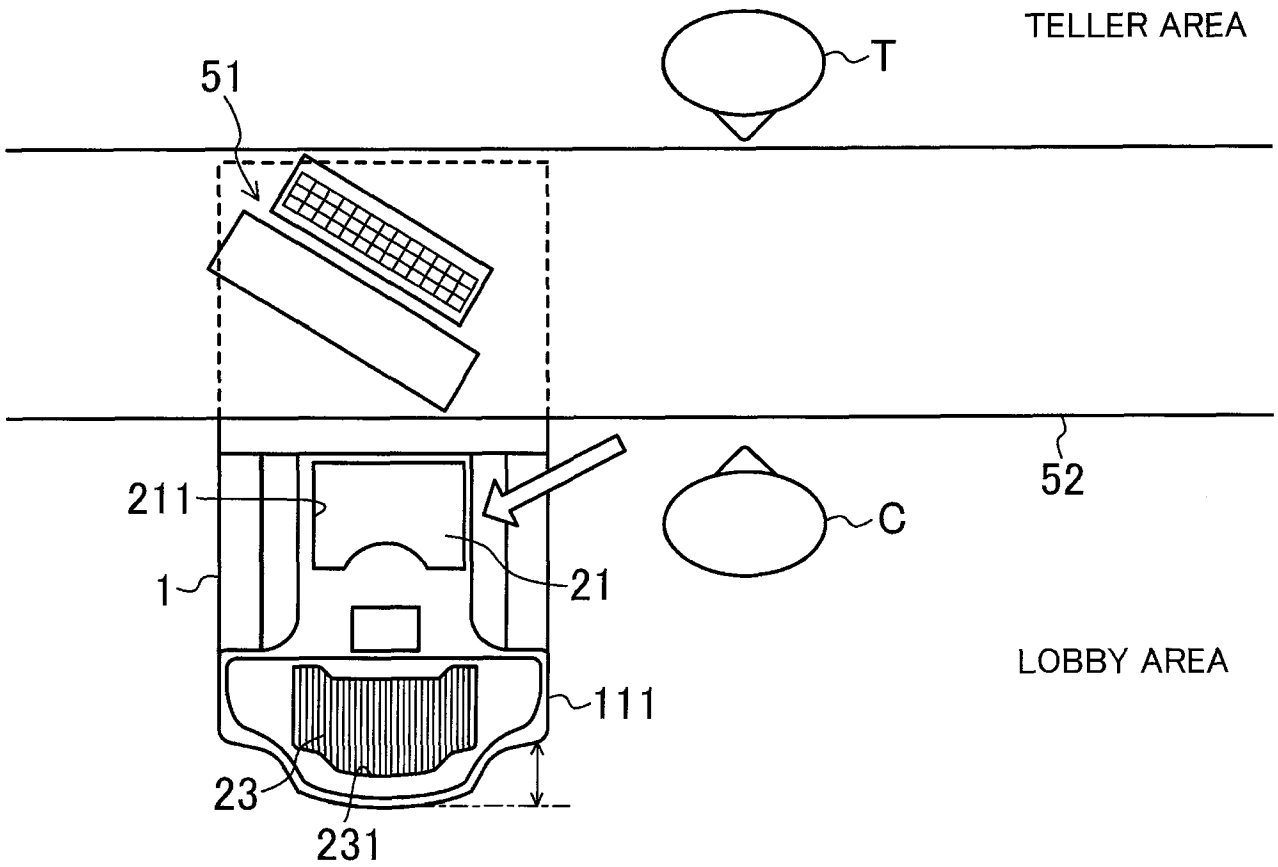
FIG. 3 is a plan view illustrating, as an example, how the banknote depositing/dispensing apparatus may be placed.

This depositing/dispensing apparatus 1 is operated in the bank by a customer C. The customer C is able to place banknotes in an inlet 211 during a depositing process to be described later, and remove banknotes from an outlet 231 during a dispensing process. There are various situations of use of the depositing/dispensing apparatus 1. For example, in one situation, a teller T of the bank may be present near the depositing/dispensing apparatus 1, and operate the higher-ranking machine 51 to perform the depositing or dispensing process. In another situation, the teller T may be present near the depositing/dispensing apparatus 1 but not usually operate the apparatus 1 to perform the depositing or dispensing process; instead, the customer C will perform the depositing or dispensing process. In a further situation, no teller T may be present near the depositing/dispensing apparatus 1. FIG. 3 shows an exemplary situation of use of the depositing/dispensing apparatus 1. In this example, the customer C and the teller T face each other over the counter 52, and the teller operates the higher-ranking machine 51 to perform the depositing or dispensing process, while the customer C places banknotes in a depositing unit 21 of the depositing/dispensing apparatus 1 or removes banknotes from a dispensing unit 23. Although not shown, as another exemplary situation of use of the apparatus, the higher-ranking machine 51 may be arranged to face the customer C, so that the customer C can, not only operate the higher-ranking machine 51 to perform the depositing or dispensing process, but also place banknotes in the depositing unit 21 of the depositing/dispensing apparatus 1 or remove banknotes from the dispensing unit 23.

The higher-ranking machine 51 shown in FIG. 3 is comprised of a display and a keyboard. However, the higher-ranking machine 51 may consist of a touchscreen display.

The depositing/dispensing apparatus 1 is roughly classified into an upper handling unit 11 and a lower safe unit 13. An upper housing 111, which forms part of the handling unit 11, houses a depositing unit 21 having an inlet 211, a dispensing unit 23 having an outlet 231, a recognition unit 27 which recognizes the banknotes, an escrow unit 32 which temporarily stores deposited banknotes or rejected banknotes recognized as those not to be dispensed, and a transport unit 41 including a loop transport path 411 that connects the depositing unit 21, the dispensing unit 23, the recognition unit 27, and the escrow unit 32. The escrow unit 32 is a detachable, optional device, and is not always provided in the depositing/dispensing apparatus 1. A protective housing 131 forming part of the safe unit 13 houses the storage unit 3. The protective housing 131 is configured to protect the storage unit 3 at a predetermined security level or higher. A display unit 54, which may be configured as a flat panel display to provide the user of the depositing/dispensing apparatus 1 with various kinds of information, is attached as an external device to the upper housing 111 as shown in FIG. 1. The display unit 54 is a detachable, optional device, and is not always provided for the depositing/dispensing apparatus 1.

An opening 1311 is formed in the rear surface of the protective housing 131 to allow the inside and outside of the protective housing 131 to communicate with each other. Although not specifically shown in FIG. 2, an openable and closable door to uncover or cover the opening 1311 is attached to the rear surface of the protective housing 131. The door may be provided with an electronic lock, for example. Unlocking the electronic lock opens the door, and allows access to, or contact with, the storage unit 3 housed in the protective housing 131. Note that the operator needs to obtain a special authorization to access the inside of the protective housing 131 that functions as a safe. As described above, the rear portion of the depositing/dispensing apparatus 1 is located in the teller area. Thus, even during the business hours of the bank, a teller can open the protective housing 131 to access the storage unit 3 with high security maintained.

A front end of the upper housing 111 bulges forward in a side view as shown in FIG. 2. A front end face of the protective housing 131 is located rearward of the front end of the upper housing 111 as indicated by the bidirectional arrow in FIG. 2. Further, when viewed in plan as shown in FIG. 3, the upper housing 111 has a center portion in the widthwise direction protruding forward as compared with right and left side portions thereof (as indicated by the bidirectional arrow in FIG. 3). According to this configuration, the right and left side portions of the depositing/dispensing apparatus 1 are recessed inward. Such a distinctive shape broadens the space around the feet of the customer C standing in front of, or diagonally in front of, the depositing/dispensing apparatus 1 to place banknotes in the depositing unit 21 or remove banknotes from the dispensing unit 23, thereby preventing the feet of the customer C from colliding against the depositing/dispensing apparatus 1. Further, this shape also prevents casters of a chair, for example, from colliding against the depositing/dispensing apparatus 1.

Figure 7:
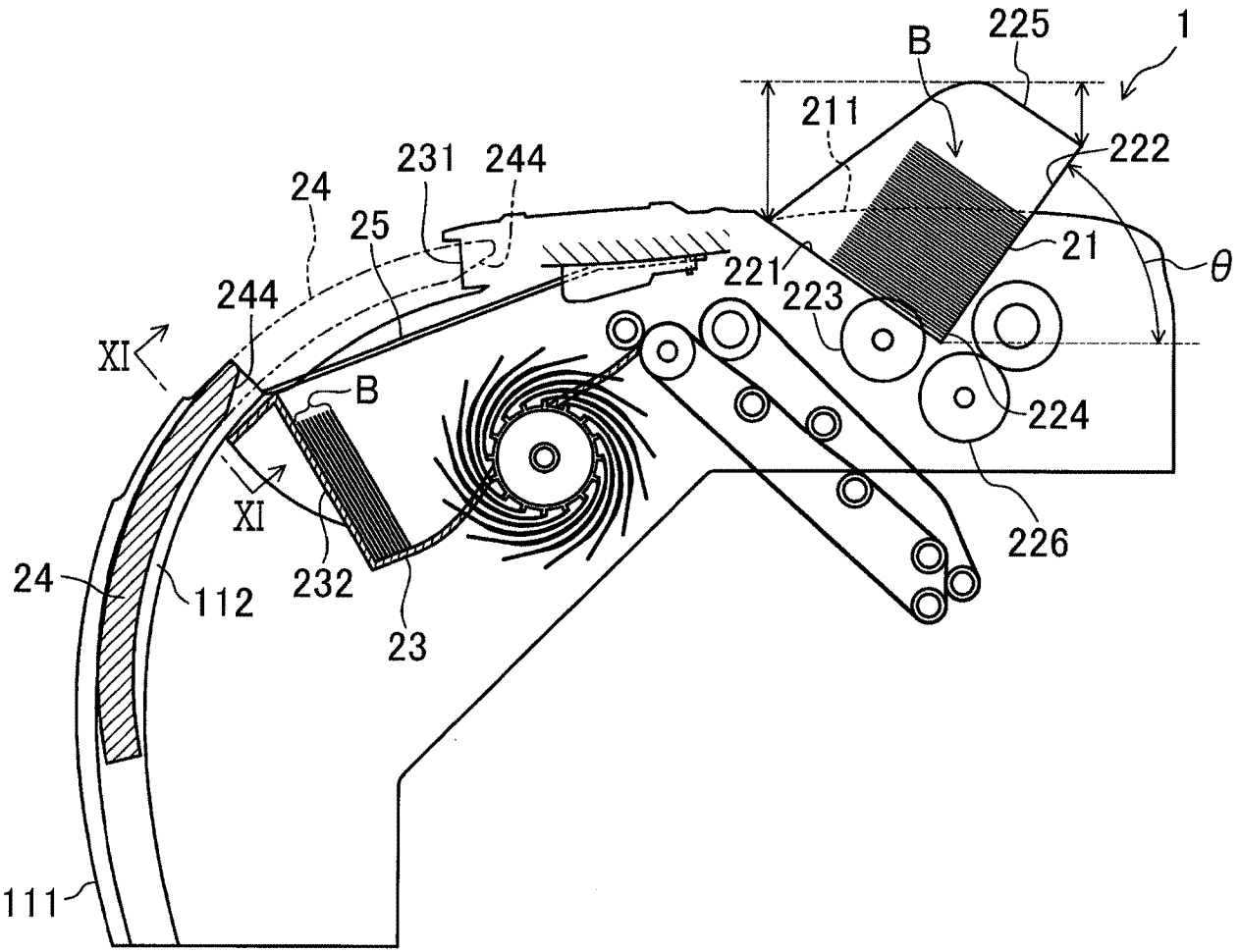
FIG. 7 is a cross-sectional view illustrating, on a larger scale, a depositing unit and dispensing unit of the banknote depositing/dispensing apparatus.

The inlet 211 is a port through which banknotes to be deposited are placed, for example, during the depositing process. As also shown in FIG. 7, the inlet 211 opens upward at the upper surface of a front portion of the upper housing 111. Since the front portion of the depositing/dispensing apparatus 1 is located in the lobby area, a customer is able to place banknotes in the inlet 211. The depositing unit 21 has no open/close unit, and the inlet 211 is always open. The depositing unit 21 is recessed downward with respect to the surface of the upper housing 111, and is configured to receive a plurality of stacked banknotes at a time. Further, the depositing unit 21 includes a feeding mechanism which feeds the banknotes placed in the inlet 211 one by one to the loop transport path 411. A detailed configuration for the depositing unit 21 will be described later.

The outlet 231 is a port through which banknotes are dispensed, for example, during the dispensing process. The outlet 231 opens upward at the upper surface of the upper housing 111, and is located forward of the inlet 211. The outlet 231, as well as the inlet 211, is located in the lobby area. Thus, the customer is able to remove the banknotes from the outlet 231. The dispensing unit 23 includes a sliding shutter 24 which covers or uncovers the outlet 231. As will be described later, the sliding shutter 24 covers the outlet 231 during the dispensing process to prevent the customer from removing the banknotes from the dispensing unit 23 at an inappropriate time. The dispensing unit 23 is recessed downward with respect to the surface of the upper housing 111 so that banknotes B transported from the inside of the housing are stacked thereon.

The recognition unit 27 is provided on the loop transport path 411, and is configured to recognize each of the banknotes being transported along the loop transport path 411 in terms of their denomination, authenticity, and fitness level. The recognition unit 27 also has the function of optically reading serial numbers printed on the banknotes.

The escrow unit 32 is a storage unit which, for example, temporarily stores the deposited banknotes until the depositing process is completed, or banknotes rejected during the dispensing process. The escrow unit 32 is configured to wind the banknotes, unlike stacking storage cassettes 31 or any other component to be described below.

The storage unit 3 includes first to fifth stacking storage cassettes (i.e., storage cases) 31. The first to fifth storage cassettes $\mathbf{31}_{-1}$-$\mathbf{31}_{-5}$ are arranged side by side in the lengthwise direction of the apparatus in the protective housing 131. The number of the storage cassettes 31 is not particularly limited, and may suitably be set to be any appropriate number of equal to or greater than one. The first to fifth storage cassettes may collectively be identified by the reference numeral "31," or may individually be identified by the reference numerals "$\mathbf{31}_{-1}$," "$\mathbf{31}_{-2}$," "$\mathbf{31}_{-3}$," . . . when they need to be distinguished from each other. Among the first to fifth storage cassettes $\mathbf{31}_{-1}$-$\mathbf{31}_{-5}$, the fourth storage cassette $\mathbf{31}_{-4}$ includes a partition arranged therein, which divides the fourth storage cassette $\mathbf{31}_{-4}$ into an upper fourth storage cassette $\mathbf{31}_{-4U}$ and a lower fourth storage cassette $\mathbf{31}_{-4L}$. Each of the storage cassettes 31 includes therein a stacking table 311, which is movable up and down, and stores the banknotes stacked from bottom to top on the stacking table 311. The stacking table 311 changes its position in the vertical direction depending on the number of banknotes to store.

The transport unit 41 includes an endless loop transport path 411 provided in the upper housing 111. A portion of the loop transport path 411 constitutes a horizontally extending transport path in the upper housing 111. Banknotes are transported clockwise or counterclockwise in FIG. 2 along the loop transport path 411. This loop transport path 411 is comprised of a combination of multiple rollers, a plurality of belts, motors driving the rollers and the belts, sensors detecting the banknotes transported, and a plurality of guides (none of which are shown). The loop transport path 411 transports the banknotes one by one, with their longer edge at the head, and a certain gap interposed between adjacent banknotes.

The loop transport path 411 is connected to the depositing unit 21, the dispensing unit 23, the first to fifth storage cassettes $\mathbf{31}_{-1}$-$\mathbf{31}_{-5}$, and the escrow unit 32 via connecting paths 412-415, respectively. A branch mechanism 42 is provided at the junction between the loop transport path 411 and the connection path 413, which is one of the connecting paths 412-415 and connected to the dispensing unit 23. The branch mechanism 42 selectively forwards the banknotes being transported either clockwise or counterclockwise along the loop transport path 411 to the connecting path 413, or forwards the banknotes being transported along the connecting path 413 to the loop transport path 411 either clockwise or counterclockwise. Another branch mechanism 42 having a similar function is also provided at the junction between the loop transport path 411 and the connecting path 415 connected to the escrow unit 32.

The connecting paths 414 are respectively connected to the storage cassettes 31 so that each one of the connecting paths 414 is connected to and associated with one of the storage cassettes 31. As described above, the fourth storage cassette $\mathbf{31}_{-4}$ is divided into the upper and lower fourth storage cassettes $\mathbf{31}_{-4U}$ and $\mathbf{31}_{-4L}$. Since two connecting paths 414 are respectively provided for the upper and lower fourth storage cassettes $\mathbf{31}_{-4U}$ and $\mathbf{31}_{-4L}$ that are regarded as two different storage cassettes, six connecting paths 414 in total are provided for the storage cassettes 31. The six connecting paths 414 are arranged side by side in the lengthwise direction of the apparatus. A gap is left in the lengthwise direction between the fourth and fifth storage cassettes $\mathbf{31}_{-4}$ and $\mathbf{31}_{-5}$, and the connecting path 414 connected to the lower fourth storage cassette $\mathbf{31}_{-4L}$ extends vertically through the gap between the fourth and fifth storage cassettes $\mathbf{31}_{-4}$ and $\mathbf{31}_{-5}$.

The six connecting paths 414 are connected to the loop transport path 411 via branch mechanisms 42, respectively. Thus, the branch mechanisms 42 of the depositing/dispensing apparatus 1 are all arranged inside the upper housing 111.

Provision of these connecting paths 414 for their respectively associated storage cassettes 31 can shorten the distance traveled by the banknotes transported between each of the storage cassettes 31 and the depositing unit 21 or the dispensing unit 23 during the depositing or dispensing process to be described later. This advantageously speeds up the process, and reduces the risk of banknote jamming.

As described above, the protective housing 131 is configured to protect the storage unit 3 at a predetermined security level or higher. For that purpose, the protective housing 131 includes a thick barrier 133 located between the protective housing 131 and the upper housing 111 to separate the protective housing 131 from the inside of the upper housing 111. The six connecting paths 414 connected to the first to fifth storage cassettes $\mathbf{31}_{-1}$-$\mathbf{31}_{-5}$ penetrate the barrier 133. Thus, the six paths are formed through the barrier 133 to be arranged side by side in the lengthwise direction of the apparatus.

As will be described later, the entire handling unit 11 including the loop transport path 411 housed in the upper housing 111 is configured to be drawn forward out of the upper housing 111, and the storage unit 3 housed in the protective housing 131 is configured to be drawn backward out of the protective housing 131. Consequently, each of the connecting paths 414 is configured to be separable at a position near the barrier 133.

Figure 4:
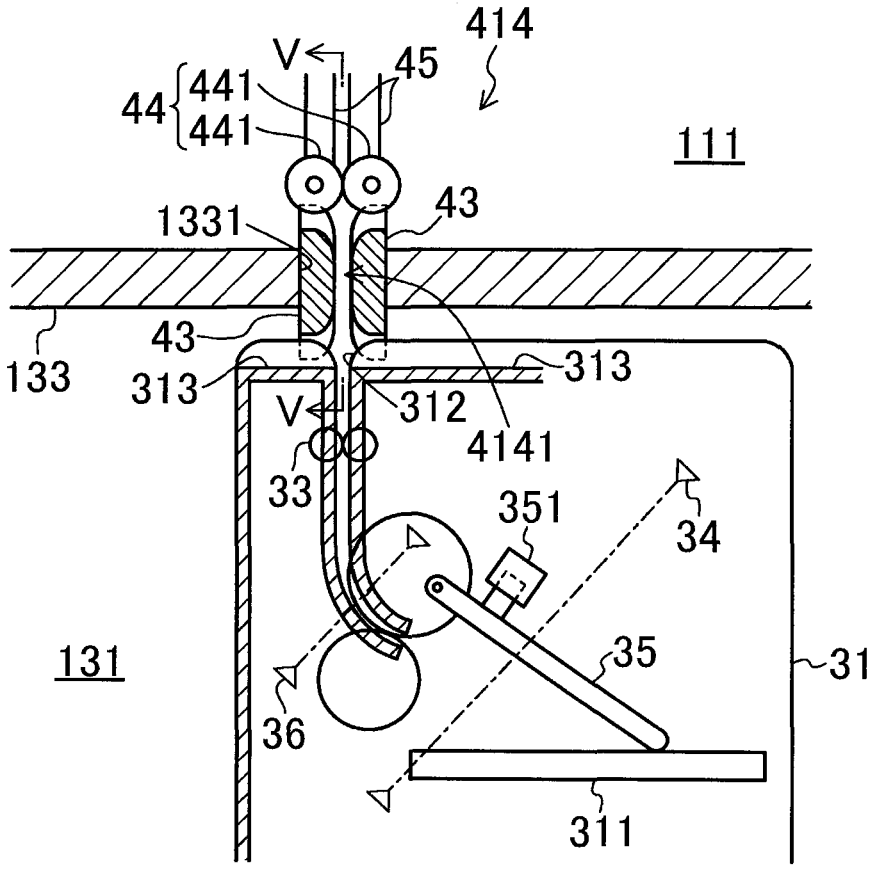
FIG. 4 is a cross-sectional view illustrating a configuration for a barrier and surrounding portions of the banknote depositing/dispensing apparatus.
Figure 5:
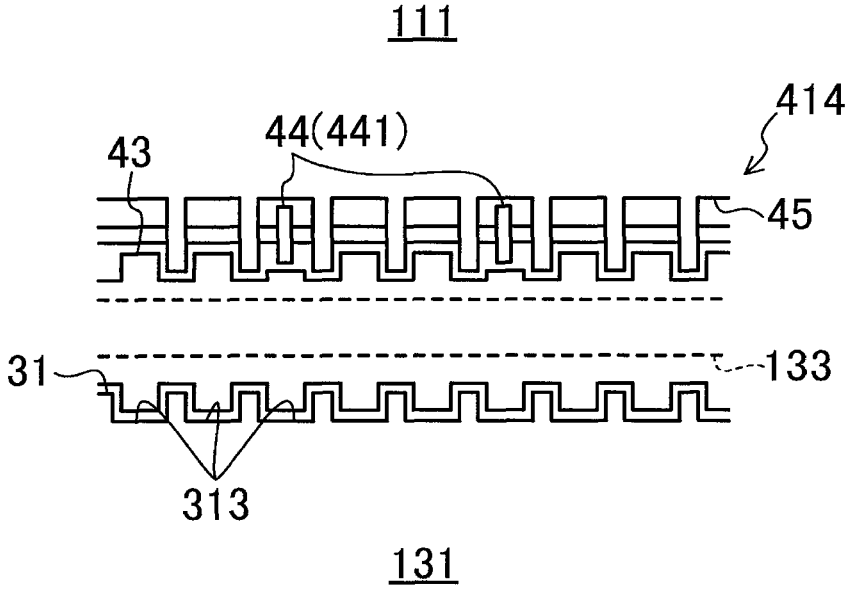
FIG. 5 is a cross-sectional view taken along the plane V-V shown in FIG. 4.

FIGS. 4 and 5 illustrate a configuration for the connecting path 414 around the barrier 133. FIG. 4 is a vertical cross-sectional view, and FIG. 5 is a cross-sectional view taken along the plane V-V of FIG. 4. A slit 1331 is formed to vertically penetrate the barrier 133. In this example, six slits 1331 are formed at six different positions in association with the six connecting paths 414. A passage member 43 is attached to each of the slits 1331. The passage member 43 is comprised of a pair of members facing each other in the lengthwise direction. The pair of passage members 43 defines a passage 4141 between them, through which the banknote passes. The passage 4141 forms part of the connecting path 414.

Each of the passage members 43 protrudes vertically upward and downward from the barrier 133. As shown in FIG. 5, an upper end (i.e., an end located inside the upper housing 111) and a lower end (i.e., an end located inside the protective housing 131) of each of the passage members 43 are substantially comb shaped, being formed by a plurality of projections and depressions arranged alternately.

As described above, each of the connecting paths 414 is separable at a position near the barrier 133. A lower end of the upper part of the connecting path 414 cut off in the upper housing 111 includes a pair of guides 45 arranged side by side in the lengthwise direction and roller pairs 44. As will be described later, the guides 45 and the roller pairs 44 move forward together with the handling unit 11 when the handling unit 11 is drawn forward out of the upper housing 111.

Each of the pair of guides 45 has a comb-shaped lower end as shown in FIG. 5, and is arranged such that the comb-shaped lower end engages with the comb-shaped upper end of an associated one of the passage members 43.

Each of the roller pairs 44 transports the banknote in the vertical direction with the banknote sandwiched between rollers 441. Each of the rollers 441 constituting the roller pair 44 is arranged between adjacent teeth of an associated one of the guides 45. The passage member 43, guide 45, and roller 441 associated with each other are arranged to partially overlap with each other in the viewing direction of FIG. 4. Thus, the upper part of the connecting path 414 in the upper housing 111 and the passage 4141 formed between the passage members 43 are continuous without a break.

A banknote port 312 is formed at an upper end surface of each of the first to fifth storage cassettes $\mathbf{31}_{-1}$-$\mathbf{31}_{-5}$ as shown in FIG. 4. The banknote port 312 allows the inside and outside of the storage cassette 31 to communicate with each other, and allows the banknote to pass through. The banknote port 312 is connected to the passage 4141 formed between the passage members 43. In addition, a plurality of grooves 313 are formed in the entire upper end surface of the storage cassettes 31 so as to extend in the lengthwise direction, and arranged side by side in the widthwise direction as shown in FIG. 5. The grooves 313 are formed to receive the projections of the comb-shaped lower end of the passage member 43. The passage members 43 and the storage cassette 31 are arranged to partially overlap with each other in the viewing direction of FIG. 4. Thus, the passage 4141 formed between the passage members 43 and the banknote port 312 are continuous without a break.

Provision of the branch mechanisms 42 of the connecting paths 414, respectively connected to the storage cassettes 31, in the upper housing 111 allows each of the banknote ports 312 of the storage cassettes 31 in the protective housing 131 to be directly connected to the passage members 43. This allows the storage cassettes 31 to be taller. As a result, the storage cassettes 31 may have an increased storage capacity without increasing the total height of the depositing/dispensing apparatus 1. Note that the operator needs to obtain a special authorization to access the inside of the protective housing 131, but does not have to obtain such a special authorization to access the inside of the upper housing 111. When a banknote is jammed in any one of the branch mechanisms 42, the transport unit 41 may be drawn out of the upper housing 111 to remove the jammed banknote from the branch mechanism 42 without obtaining any special authorization. Since the plurality of branch mechanisms 42, in which the banknote tends to be jammed relatively frequently, are housed in the upper housing 111, the banknote jamming may quickly be resolved, thus improving the maintainability of the apparatus. Further, since there are no branch mechanisms 42 in the protective housing 131, the possibility of the banknote jamming in the protective housing 131 may be reduced.

Although not shown, a portion of the connecting path 414 connected to the lower fourth storage cassette $\mathbf{31}_{-4L}$ around the barrier 133 has substantially the same configuration as that shown in FIGS. 4 and 5.

Figure 6:
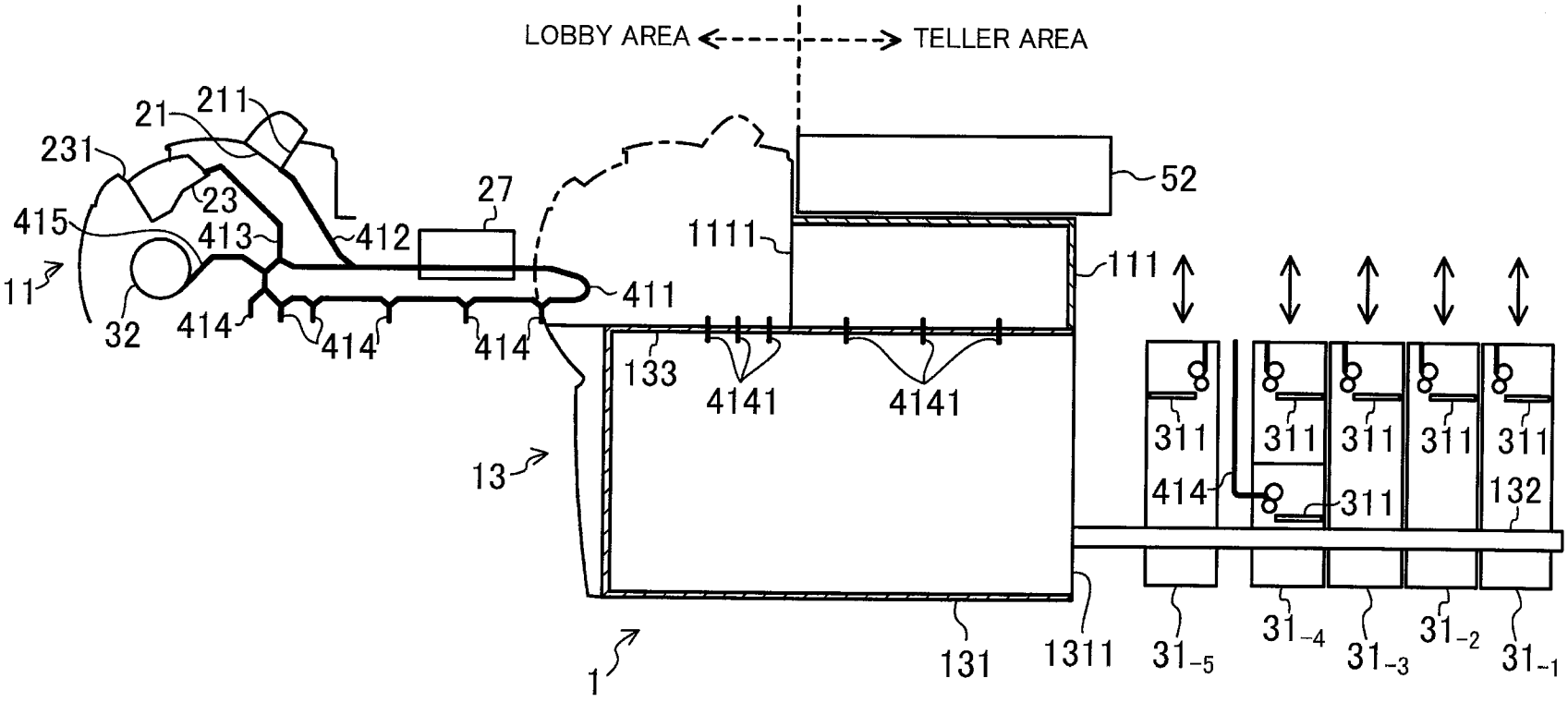
FIG. 6 is a conceptual diagram illustrating the banknote depositing/dispensing apparatus in an open configuration.

As shown in FIG. 6, the storage unit 3 may be drawn backward of the apparatus with the open/close door of the protective housing 131 opened to uncover the opening 1311. Since the rear portion of the depositing/dispensing apparatus 1 is located in the teller area, the storage unit 3 is drawn out of the protective housing 131 in the teller area where no customers are present. Thus, management of the storage unit 3 assigned to a clerk of a bank, such as collecting the banknotes from the storage unit 3 and replenishing the storage unit 3 with the banknotes, may be carried out in the teller area. Consequently, the collection and replenishment of the banknotes may be carried out with high security ensured even during the business hours of the bank when customers are present in the lobby area. This contributes to smooth operation of the depositing/dispensing apparatus 1.

The storage cassettes 31 are attached to a tray 132 which is slidable in the lengthwise direction relative to the protective housing 131. When the storage unit 3 is drawn out of the protective housing 131, lower ends of the passage members 43 attached to the barrier 133 pass through the grooves 313 in the upper end surface of the storage cassettes 31. Thus, the storage cassettes 31 are able to move without any interference with the passage members 43. With the storage unit 3 drawn backward of the apparatus, the storage cassettes 31 are removed from, or attached to, the tray 132 (as indicated by the bidirectional arrows in FIG. 6).

The handling unit 11 including the transport unit 41 housed in the upper housing 111 is configured to be entirely drawable forward of the apparatus as shown in FIG. 6. The upper housing 111 is divided into a front housing and a rear housing, and the front housing moves forward together with the handling unit 11. After the front housing has moved, an opening 1111 provided for the remaining rear housing appears.

As can be seen, the handling unit 11 is drawn forward of the apparatus, while the storage unit 3 is drawn backward of the apparatus, with the barrier 133 having a plurality of passages 4141 staying inside the apparatus. The inside of the depositing/dispensing apparatus 1 is accessible from two different directions, namely, through a front opening (i.e., the opening 1111 of the upper housing 111) and a rear opening (i.e., the opening 1311 of the protective housing 131). This configuration improves maintainability as compared with a generally known depositing/dispensing apparatus which allows the operator to access the inside of the apparatus only through the front opening. In particular, the depositing/dispensing apparatus 1 has a relatively large dimension in the lengthwise direction, and the barrier 133 is provided with the plurality of passages 4141 arranged side by side in the lengthwise direction. The bidirectional access to the inside of the apparatus through both of the front and rear openings 1111 and 1311 allows the operator to access every passage 4141 easily. This facilitates the removal of a jammed banknote beneficially, particularly when the banknote is jammed around the passage 4141 of the barrier 133.

In this regard, a generally known banknote handling apparatus adopts a configuration to prevent a banknote, which has been jammed around the passage 4141 formed through the barrier 133, from being left around the passage 4141. Specifically, in this configuration, the grip force P1 of roller pairs arranged in the upper housing 111 (corresponding to the roller pairs 44 shown in FIG. 4) is set to be different from the grip force P2 of roller pairs arranged in the protective housing 131 (corresponding to the roller pairs 33 in the storage cassette 31 shown in FIG. 4) (e.g., P1>P2), and the direction of rotation of the roller pairs 44 in the upper housing and the direction of rotation of the roller pairs 33 in the protective housing are controlled in accordance with the location of the banknote jammed (i.e., a configuration in which P1 and P2 are different, and the rotation control is performed on the boundary between the upper and protective housings). Applying such a configuration to this depositing/dispensing apparatus 1 would eliminate jamming of banknotes that could be left around the barrier 133 with some portion thereof jammed in the upper housing and another portion thereof jammed in the protective housing, thus reducing the risk of tearing the banknote unintentionally when the handling unit 11 or the storage unit 3 is drawn out. Further, as described above, the depositing/dispensing apparatus 1 allows a teller or an operator to easily access every passage 4141 formed through the barrier 13 via the two openings, namely, the front and rear openings 1111 and 1311, thus eliminating any cause of banknote jamming.

Moreover, as shown in FIG. 6, the handling unit 11 in the upper housing 111 is drawn forward of the apparatus, while the storage unit 3 in the protective housing 131 is drawn backward of the apparatus. Thus, if two different persons are performing maintenance of the handling unit 11 and the storage unit 3, respectively, the handling unit 11 and the storage unit 3 can be maintained in parallel. This shortens the amount of time required to do the maintenance of the apparatus.

(Configuration of Depositing Unit)

A configuration of the depositing unit 21 will be described below. FIG. 7 is a cross-sectional view illustrating, on a larger scale, the vicinity of the depositing unit 21 and dispensing unit 23 of the depositing/dispensing apparatus 1. As described above, the depositing unit 21 is recessed downward with respect to the surface of the upper housing 111 of the depositing/dispensing apparatus 1. The inlet 211 is formed in the surface of the upper housing 111.

The depositing unit 21 has a substantially triangular cross-section formed by a first slope 221 and a second slope 222. A plurality of banknotes B can be placed in the depositing unit 21 so as to be stacked in the direction along the second slope 222, with a front or rear surface of the lowermost one of the banknotes B in contact with the first slope 221, and one longer edge of each of the banknotes B in contact with the second slope 222. The first slope 221 is provided with intake rollers 223, and an intake port 224 formed at the junction between the first and second slopes 221 and 222 to take the banknotes B into the apparatus. The banknotes B placed in, and stacked on, the depositing unit 21 are taken one by one into the apparatus through the intake port 224 by the intake rollers 223 in the direction along their shorter edges.

The second slope 222 has an inclination angle θ of about 55°±10°. This inclination angle θ is smaller than the inclination angle θ of a generally known banknote sorter or banknote depositing/dispensing machine, which is about 70-75°. A smaller inclination angle θ allows the inlet 211 to open wider toward the rear side of the apparatus. For example, when the depositing/dispensing apparatus 1 is used as shown in FIG. 3, this inclination angle allows the customer C standing beside the depositing/dispensing apparatus 1 to place banknotes easily and conveniently through the inlet 211 from beside, or obliquely behind, the depositing unit 21 as indicated by the open arrow shown in FIG. 3. In addition, the number of banknotes B that can be placed at a time in the depositing unit 21 may be increased as well. That is, the smaller inclination angle θ of the second slope 222 allows the customer to easily place the banknotes in the depositing unit 21, and ensures an increased capacity for the depositing unit 21.

As also shown in FIGS. 1 and 7, the depositing unit 21 includes guide walls 225 which guide the shorter edges of the banknotes. The guide walls 225 protrude upward with respect to the inlet 211. Each of the guide walls 225 is shaped such that its height is maximized at its center portion in the lengthwise direction (corresponding to the transverse direction of the paper of FIG. 7), and the height gradually decreases toward the front and rear ends thereof (as indicated by the bidirectional arrows in FIG. 7). As shown in FIG. 7, in a side view, each of the guide walls 225 has the maximum height at a portion right over the intake port 224 of the depositing unit 21. This shape of the guide walls 225 allows a large number of banknotes to be held stably. Further, this shape facilitates the placement of banknotes in the depositing unit 21 from the front of the depositing/dispensing apparatus 1, and allows the customer standing beside the apparatus (who is going to place the banknotes from beside, or obliquely behind, the depositing unit 21 as indicated by the open arrow in FIG. 3) to easily place the banknotes through a shorter portion of the guide wall 225. Thus, the banknotes can be placed into the depositing unit 21 more easily.

The guide walls 225 are made of a transparent or translucent material with a light-transmitting property. Therefore, if the apparatus is used as shown in FIG. 3, for example, the customer who is going to place the banknotes from beside, or obliquely behind, the depositing/dispensing apparatus 1 is able to see the position of the inlet 211 through the guide wall 225. This facilitates the placement of the banknotes in the depositing unit 21.

Note that the second slope 222 may be configured to have an adjustable length such that the capacity of the depositing unit 21 is changeable.

As another example, an open/close unit which covers or uncovers the inlet may be provided to limit the access to the inlet. The open/close unit may be operated automatically or manually. Alternatively, the open/close unit may be used at appropriate times only when the need to limit the depositing arises.

(Configuration of Dispensing Unit)

Figure 8:
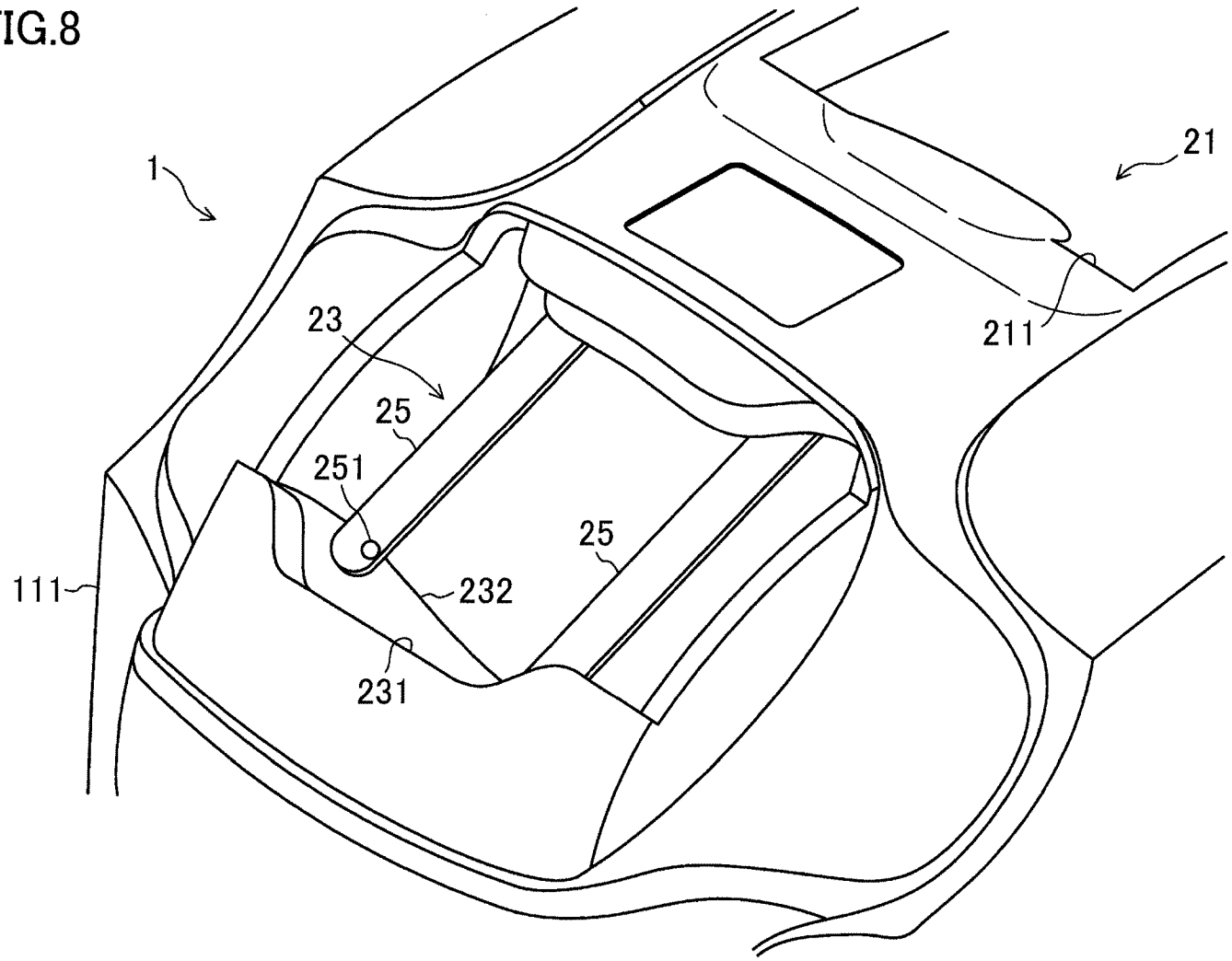
FIG. 8 is a perspective view illustrating, on a larger scale, the dispensing unit of the banknote depositing/dispensing apparatus.

A configuration of the dispensing unit 23 will be described in detail below. FIG. 8 is a perspective view illustrating, on a larger scale, the dispensing unit of the depositing/dispensing apparatus 1 and members surrounding it. As described above, the dispensing unit 23 is recessed downward with respect to the surface of the upper housing 111 of the depositing/dispensing apparatus 1, and the outlet 231 is formed in the surface of the upper housing 111.

The dispensing unit 23 has an open/close unit which covers or uncovers the outlet 231. The open/close unit of this example is a sliding shutter 24 configured to cover or uncover the outlet 231 by moving between one edge of the outlet 231 and the other. The sliding shutter 24 covers the outlet 231 when the tip end thereof moves from the other edge of the outlet 231 to one edge thereof as indicated by the phantom line in FIG. 7. Further, the sliding shutter 24 uncovers the outlet 231 when the tip end thereof moves from the one edge of the outlet 231 to the other edge thereof as indicated by the solid line in FIG. 7. FIG. 8 shows a state where the sliding shutter 24 is opened to uncover the outlet 231. The sliding shutter 24 is opened or closed in accordance with an open/close signal supplied from the higher-ranking machine 51.

Figure 9:
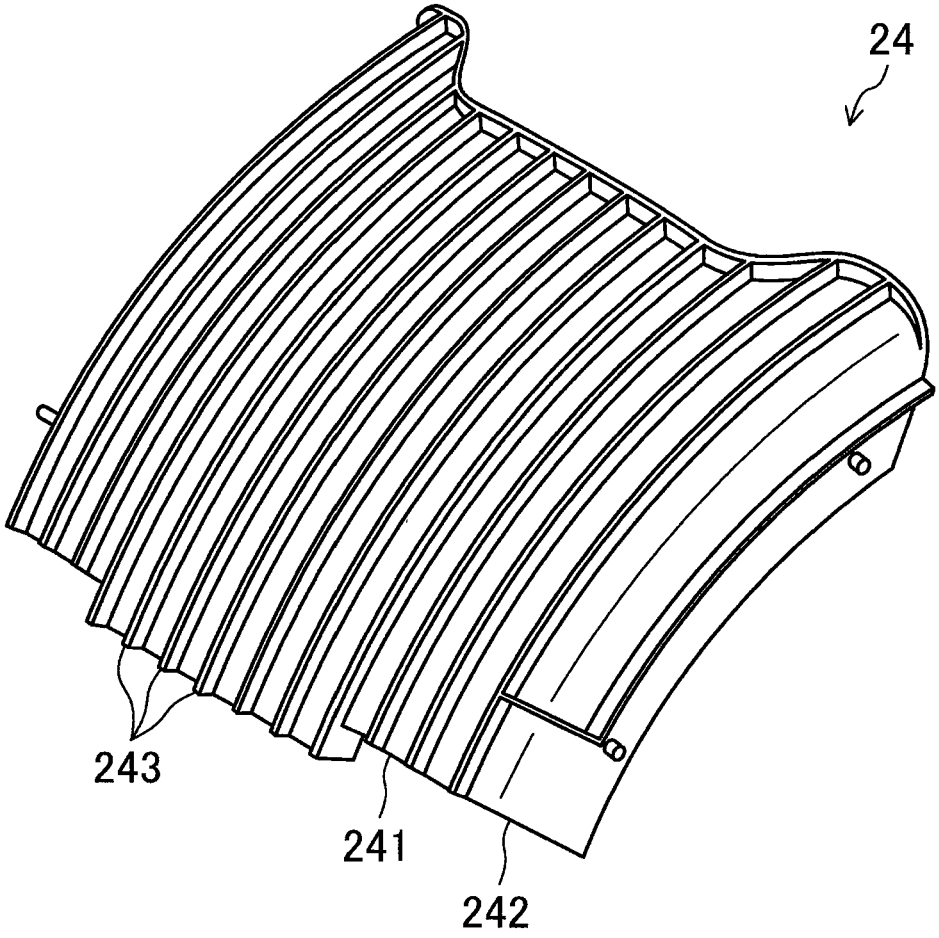
FIG. 9 is a perspective view illustrating a sliding shutter.
Figure 10:
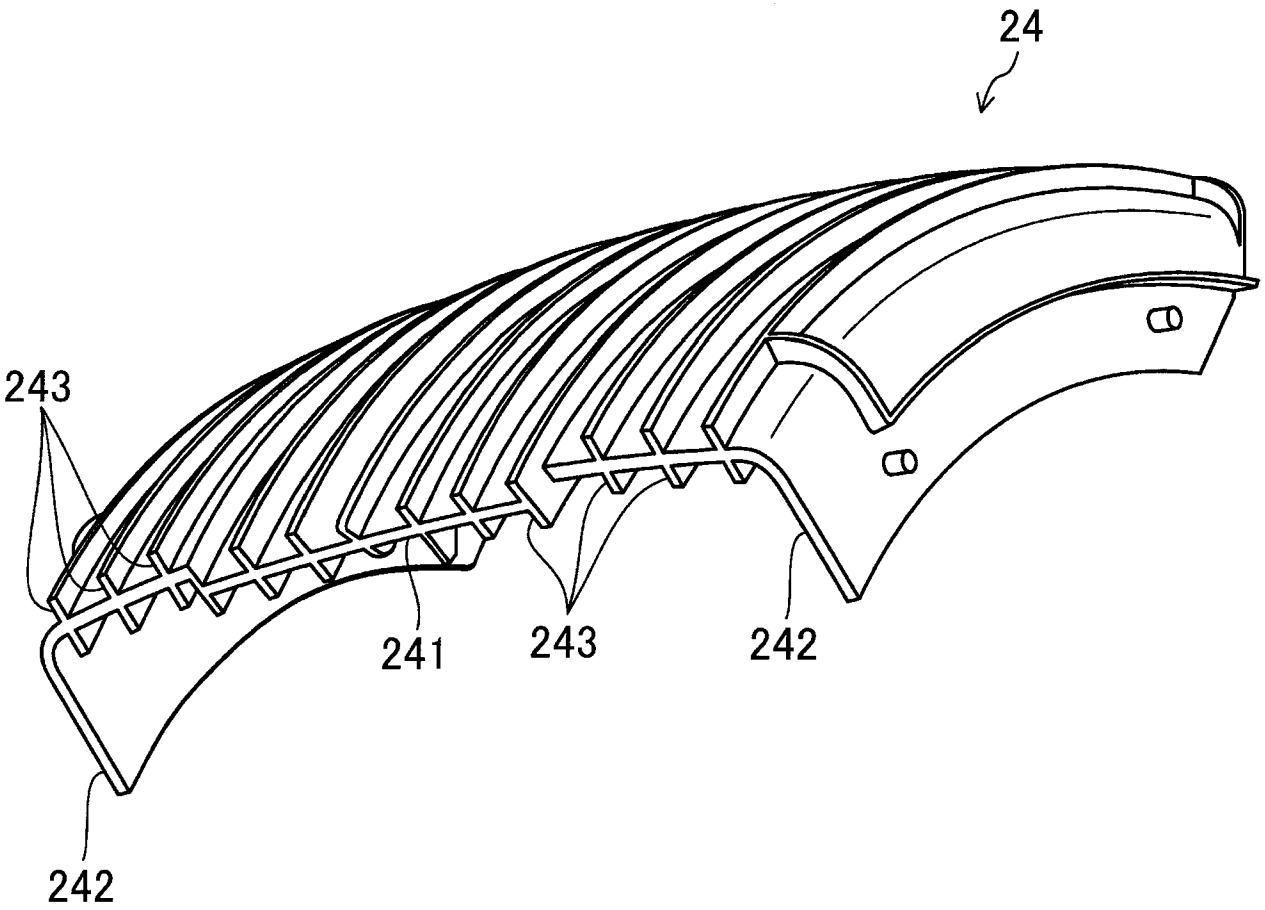
FIG. 10 is a perspective view illustrating the sliding shutter as viewed from a different angle from FIG. 9.

As also shown in FIGS. 9 and 10, the sliding shutter 24 includes a plate-like body 241 which covers the outlet 231, and guides 242 respectively extending downward from right and left edges of the body 241. Thus, the body 241 has the shape of an inverted U when viewed in transverse section (see also FIG. 11). The body 241 is curved with respect to the open/close direction of the sliding shutter 24. The sliding shutter 24 covers or uncovers the outlet 231 by moving along an arc as shown in FIG. 7.

The sliding shutter 24 is made of an opaque material. When the sliding shutter 24 covers the outlet 231, the inside of the dispensing unit 23 is invisible from the outside. Alternatively, the sliding shutter 24 may be made of a transparent or translucent material having a light-transmitting property such that the inside of the dispensing unit 23 may be visible from the outside even while the outlet 231 is covered with the sliding shutter 24.

The plate-like body 241 has a plurality of ribs 243 protruding from an outer surface (i.e., the surface) and an inner surface (i.e., the reverse surface) thereof. The plurality of ribs 243 extend in the open/close direction of the sliding shutter 24. The plurality of ribs 243 are arranged side by side over the entire body 241 in the widthwise direction intersecting with the open/close direction at right angles. The ribs 243 extend over the entire length of the body 241 from the tip end of the body 241 through the base end thereof.

Figure 11:
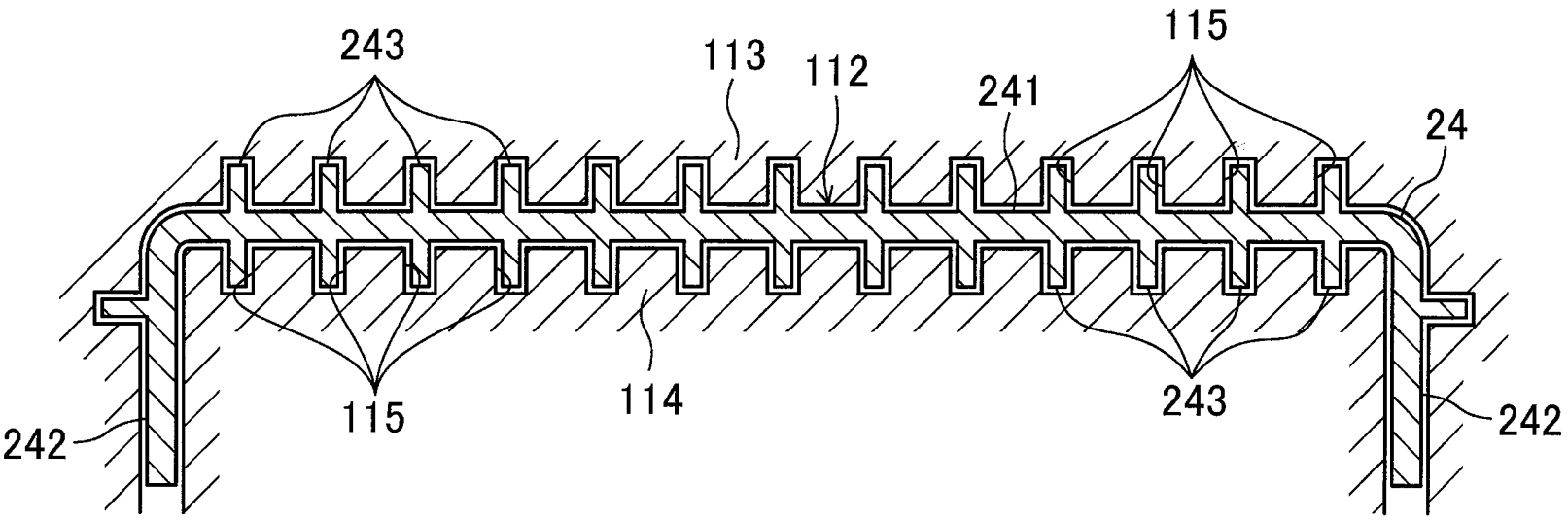
FIG. 11 is a cross-sectional view taken along the plane XI-XI shown in FIG. 7.

When the outlet 231 is opened as indicated by the solid line in FIG. 7, the sliding shutter 24 is housed in a shutter pocket 112 provided inside the wall of the upper housing 111. The shutter pocket 112 is defined by, as shown in FIG. 11, an outer wall member 113 facing the outer surface of the sliding shutter 24 and an inner wall member 114 facing the inner surface of the sliding shutter 24.

Each of the outer and inner wall members 113 and 114 forming the shutter pocket 112 has a plurality of grooves 115 arranged side by side in the widthwise direction intersecting with the open/close direction at right angles so as to receive their associated ribs 243 of the sliding shutter 24. Each groove 115 is formed at least around an opening of the shutter pocket 112, through which the sliding shutter 24 comes in and goes out of the shutter pocket 112. Each groove 115 may extend over the shutter pocket 112 in the open/close direction of the sliding shutter 24. Each rib 243 passes through an associated one of the grooves 115 when the sliding shutter 24 moves. The ribs 243 of the sliding shutter 24 and the grooves 115 of the outer and inner wall members 113 and 114 form a rectangular wave gap between the sliding shutter 24 and the outer and inner wall members 113 and 114 around the opening of the sliding shutter 24. The rectangular wave gap effectively prevents the banknotes or any other paper sheets from entering the inside of the depositing/dispensing apparatus 1 through the gap. Note that the sliding shutter 24 may have the ribs 243 only on one of the outer and inner surfaces of the body 241. In that case, the grooves 115 may be formed in only one of the outer and inner wall members 113 and 114 facing the surface with the ribs 243.

The dispensing unit 23 further includes a stopper 25 located inward of the sliding shutter 24 to prevent banknotes dispensed to the dispensing unit 23 from popping out of the outlet 231. The stopper 25 is configured as a strip-shaped, elastically deformable member. The stopper 25 may be made of, for example, a synthetic resin in the form of a transparent film.

In the illustrated example, the stopper 25 includes two stoppers 25 spaced apart from each other in the widthwise direction. As shown in FIGS. 7 and 8, each of the stoppers 25 is arranged such that a base end thereof is fixed to the ceiling surface of the dispensing unit 23 at one edge of the outlet 231 (i.e., one edge of the outlet on the right-hand side in FIGS. 7 and 8), and a tip end thereof reaches the other edge of the outlet 231 (i.e., an edge of the outlet on the left-hand side in FIGS. 7 and 8). Thus, the stoppers 25 arranged across the outlet 231 prevent the banknotes, which are being fed to the dispensing unit 23 with the outlet 231 uncovered with the sliding shutter 24, from popping out of the outlet 231. Meanwhile, the stoppers 25 are elastically deformed to allow the user to remove the banknotes stacked in the dispensing unit 23 through the outlet 231. Once the banknotes have been removed, the stoppers 25 recover their original shape to extend across the outlet 231.

A holder 232 which holds the banknotes B in an upright position is attached to the dispensing unit 23 around the other edge of the outlet 231. The respective tip ends of the stoppers 25 abut on, but not fixed to, an upper end of the holder 232 (see FIG. 7). Specifically, each of the stoppers 25 extends obliquely downward from the one edge of the outlet 231 to the other. In other words, each of the stoppers 25 extends in a direction away from the sliding shutter 24 toward the inside of the dispensing unit 23. Each of the stoppers 25 extending from the one edge of the outlet 231 to the other is cantilevered to the outlet 231. That is, the respective tip ends of the stoppers 25 are free, unfixed ends, whereas the sliding shutter 24 moves such that a tip end thereof travels to the one edge of the outlet 231 from the other edge thereof so as to face the cantilevered stoppers 25. Thus, the stoppers 25 may possibly interfere with the sliding shutter 24 being closed. However, the interference between the sliding shutter 24 and the stoppers 25 may be substantially prevented if the respective tip ends of the stoppers 25 are biased toward the holder 232 inside the dispensing unit 23 relative to the sliding shutter 24.

Further, as shown in FIG. 8, a weight 251 is laid on each of the respective tip ends of the stoppers 25 to press the tip end downward. In FIG. 8, the weight 251 laid on the stopper 25 on the frontend side is not shown because it is hidden behind the edge of the outlet 231. The weights 251 reliably bring the respective tip ends of the elastically deformable stoppers 25 into contact with the upper end of the holder 232, thereby more effectively preventing the interference between the sliding shutter 24 and the stoppers 25. Optionally, the weights 251 may be omitted.

As shown in FIG. 7, the inner surface of the tip end portion of the sliding shutter 24 has a bevel 244 which is inclined away from the stoppers 25 as it goes toward the tip end. Note that this inner surface is comprised of the respective protruding ends of the ribs 243. Even if the respective tip ends of the stoppers 25 collide against the sliding shutter 24 being closed, the bevel 244 allows the respective tip ends of the stoppers 25 to move along the bevel 244 to a position deeper inside the dispensing unit 23 than the sliding shutter 24. Thus, the stoppers 25 are prevented from running onto the sliding shutter 24 being closed.

Note that an open/close unit for covering or uncovering the outlet 231 is not limited to the sliding shutter 24, but various other types of members may be used. For example, a telescopic, winding, or folding open/close unit may also be used. Alternatively, a pivotable open/close unit may also be used.

Further, the sliding shutter 24 is not necessarily housed in the shutter pocket 112 when opened to uncover the outlet 231.

(Configuration of Control-Related Components of Depositing/Dispensing Apparatus)

Figure 12:
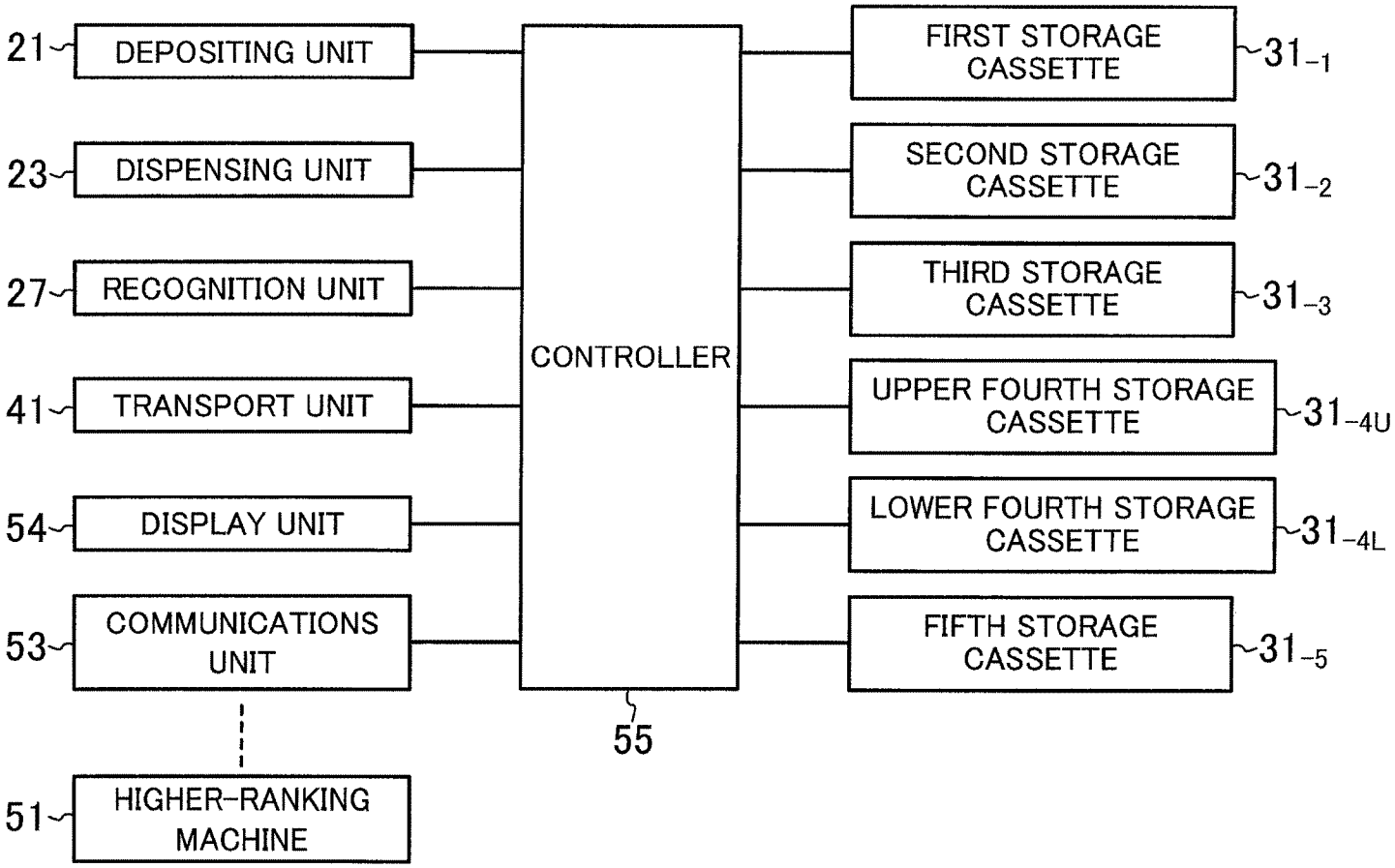
FIG. 12 is a block diagram illustrating a configuration for control-related components of the banknote depositing/dispensing apparatus.

FIG. 12 is a block diagram illustrating a configuration for control-related components of the depositing/dispensing apparatus 1. The depositing/dispensing apparatus 1 includes a controller 55. The controller 55 is connected to the above-described components, namely, the depositing unit 21, the dispensing unit 23, the recognition unit 27, the transport unit 41, the first storage cassette $\mathbf{31}_{-1}$, the second storage cassette $\mathbf{31}_{-2}$, the third storage cassette $\mathbf{31}_{-3}$, the upper and lower fourth storage cassettes $\mathbf{31}_{-4U}$ and $\mathbf{31}_{-4L}$, and the fifth storage cassette $\mathbf{31}_{-5}$ so that signals may be transmitted to, and received from, these components.

The controller 55 is also connected to a communications unit 53 for communicating with the higher-ranking machine 51 so that signals may be transmitted to, and received from, the communications unit 53. A display unit 54 is also connected to the controller 55 so that signals may be transmitted to, and received from, the controller 55.

Next, it will be described briefly how the depositing/dispensing apparatus 1 with the above-described configuration performs depositing and dispensing processes as typical examples of the various types of processes to be performed by the apparatus 1.

(Depositing Process)

The depositing process is a process of storing normal banknotes placed in the depositing unit 21 into one of the storage cassettes 31. The banknotes placed in the depositing unit 21 are stored in a predetermined one of the storage cassettes 31 according to the result of recognition by the recognition unit 27 and a preset rule for storing the banknotes.

First, with the banknotes to be deposited placed in the depositing unit 21 by a customer, the higher-ranking machine 51 is operated to input a command to start the depositing process to the depositing/dispensing apparatus 1. The feeding mechanism of the depositing unit 21 feeds the banknotes in the depositing unit 21 one by one, and the transport unit 41 transports each of the banknotes to the recognition unit 27. The recognition unit 27 recognizes and counts the banknotes, and reads their serial numbers.

In accordance with the result of recognition, the transport unit 41 stores normal banknotes in the predetermined storage cassette 31 either immediately or after having temporarily stored the normal banknotes in the escrow unit 32. That is, each of the banknotes is stored in one of the first to fifth storage cassettes 31 in accordance with its denomination or fitness/unfitness.

The transport unit 41 transports rejected banknotes to the dispensing unit 23. Banknotes rejected during the depositing process are placed again in the depositing unit 21, and recognized again by the recognition unit 27. During the depositing process, the sliding shutter 24 uncovers the outlet 231. Thus, if the rejected banknotes are dispensed to the dispensing unit 23, the customer is able to smoothly place the rejected banknotes again in the depositing unit 21. While the outlet 231 is uncovered, the stoppers 25 prevent the banknotes dispensed to the dispensing unit 23 from popping out of the outlet 231.

Alternatively, the sliding shutter 24 may cover the outlet 231 during the depositing process. In that case, the sliding shutter 24 may uncover the outlet 231 only when all the banknotes placed in the depositing unit 21 have been taken in the depositing/dispensing apparatus 1 and the rejected banknotes have been dispensed to the dispensing unit 23. This allows the customer to remove the rejected banknotes from the dispensing unit 23 at an appropriate time and place the rejected banknotes again in the depositing unit 21.

At this time, the banknotes taken in the depositing unit 21 will be transported differently depending on the position of the banknotes placed in the depositing unit 21 (i.e., the position in the longitudinal direction of the depositing unit 21). For example, if the banknotes are placed not at a longitudinal center position of the depositing unit 21, but at a position closer to one of longitudinal edges of the depositing unit 21, the banknotes will be transported into the apparatus from that position. Then, these banknotes may be more likely rejected based on a determination that the risk of causing a fault such as a stacking failure is high. Further, if an anti-counterfeit element (e.g., a security thread) is provided on one of the surfaces of the banknote, the banknote may be rejected based on a determination that the risk of causing a fault such as a stacking failure is high, unless the banknote is placed in the depositing unit 21 with the anti-counterfeit element facing a predetermined direction. Moreover, if a hologram or polymer is partially used on the banknote, a frictional force between the banknote and the intake rollers 223 or feed rollers 226 of the depositing unit 21 may change when the hologram or polymer comes into contact with these rollers 223 or 226, which may significantly skew the banknote. In that case, the banknote is likely rejected as well.

As can be seen, the banknote may be rejected depending on how the banknote is placed in the depositing unit 21. If the banknote were placed inappropriately, the number of rejected banknotes which should be placed again would increase. In particular, since the depositing/dispensing apparatus 1 allows the customer to place the banknotes in the depositing unit 21, there is a strong possibility of banknotes being placed inappropriately.

To cope with this problem, the depositing/dispensing apparatus 1 calls the customer's attention by displaying, in the display unit 54, guidance on how to place the banknotes appropriately in the depositing unit 21. This reduces the possibility of banknotes being rejected, thus quickly completing the depositing process.

The display unit 54 may display the guidance when the depositing process is started, i.e., when the customer places the banknotes in the depositing unit 21. Alternatively, the guidance may also be displayed when the banknotes has been rejected a predetermined number of times or more since the start of the depositing process. In such a case, a cause of the rejection of the banknote is apparent, and thus, guidance on how to place the banknote appropriately to eliminate the cause may be presented to the customer. As described above, the depositing unit 21 is always open. Thus, the position or orientation of the banknotes placed in the depositing unit 21 is changeable even during the depositing process. Therefore, during the depositing process, it is sufficient to display guidance that advises the customer to suitably change the position or orientation of the banknotes being placed in the depositing unit 21. At this time, the depositing process may be continued, or temporarily suspended until the banknotes' position or orientation is changed, for example.

Alternatively, the display unit 54 may display the guidance when the rejected banknotes are placed again in the depositing unit 21 after all the banknotes placed in the depositing unit 21 have been taken in.

The guidance displayed on the display unit 54 may be a combination of letters, illustrations, symbols, photos, animation, movies, and any other kind of visual information.

(Dispensing Process)

The dispensing process is a process of dispensing normal banknotes stored in the depositing/dispensing apparatus 1. The dispensing process starts when the higher-ranking machine 51 is operated to perform a predetermined dispensing operation including the designation of the amount to be dispensed. After the denomination and number of banknotes to meet the designated amount have been specified, the storage unit 3 feeds the requested number of banknotes of the specified denomination from the storage cassette 31 storing the banknotes of that denomination. The transport unit 41 transports the fed banknotes to the recognition unit 27. The recognition unit 27 recognizes the banknotes and reads the serial numbers of the banknotes, and then the normal banknotes are dispensed to the dispensing unit 23. The customer takes the dispensed banknotes through the outlet 231.

The banknotes rejected during the dispensing process are transported to, and stored in, the escrow unit 32. The banknotes stored in the escrow unit 32 are stored in the storage cassettes 31 as needed after the dispensing process is finished.

During the dispensing process, the sliding shutter 24 covers the outlet 231. The customer is not able to remove the banknotes from the outlet 231 during the dispensing process, i.e., while the banknotes are being dispensed. After the banknotes to be dispensed through the dispensing process are all dispensed to the dispensing unit 23, the higher-ranking machine 51 sends a signal to open the sliding shutter 24 to the depositing/dispensing apparatus 1. In accordance with the signal, the sliding shutter 24 uncovers the outlet 231. The customer is then able to remove the banknotes stacked in the dispensing unit 23 through the outlet 231. The sliding shutter 24 covers the outlet 231 while the removal of the banknotes from the dispensing unit 23 is prohibited, i.e., during the dispensing process. This prohibits the customer from removing the banknotes from the dispensing unit 23 at an inappropriate time. On the other hand, the sliding shutter 24 uncovers the outlet 231 when the banknotes in the dispensing unit 23 may be removed, e.g., after the dispensing process is finished. This allows the customer to remove the banknotes from the dispensing unit 23 at an appropriate time.

If the number of banknotes to be dispensed through the dispensing process is so large as to exceed the capacity of the dispensing unit 23, the dispensing process may be suspended at a suitable time before the dispensing unit 23 goes full, and the sliding shutter 24 may uncover the outlet 231 in accordance with the signal from the higher-ranking machine 51. This allows the customer to remove the banknotes from the dispensing unit 23 at an appropriate time. After the customer has removed the banknotes, the sliding shutter 24 may cover the outlet 231, and the dispensing process suspended may be resumed in accordance with the signal from the higher-ranking machine 51.

(Control Performed when Fault Occurred During Depositing or Dispensing Process)

The depositing/dispensing apparatus 1 includes a plurality of storage cassettes 31, and the denomination and fitness/unfitness of the banknotes to be stored in each of the storage cassettes 31 are specified in advance. The denomination and other parameters of the banknotes to be stored in each of the storage cassettes 31 may be specified as needed by a user. For example, if the number of banknotes of a particular denomination to be handled is larger than that of banknotes of any other denomination, two or more storage cassettes 31 may be able to store the banknotes of the same denomination in accordance with the user's settings.

If the storage cassette 31 storing the banknotes causes a fault during the depositing process described above, a depositing/dispensing apparatus with a generally known configuration suspends the depositing process to execute a recovery operation for resolving the fault of the storage cassette 31. Then, in a situation where the fault has been resolved by the recovery operation, the depositing process is resumed. Alternatively, in a situation where the fault has not been resolved even by the recovery operation, the depositing process is canceled and the apparatus is stopped based on a determination that an error has occurred.

Likewise, if the storage cassette 31 feeding the banknotes causes a fault during the dispensing process, a depositing/dispensing apparatus with a generally known configuration suspends the dispensing process to execute a recovery operation for resolving the fault of the storage cassette 31. Then, in a situation where the fault has been resolved by the recovery operation, the dispensing process is resumed. Alternatively, in a situation where the fault has not been resolved even by the recovery operation, the dispensing process is canceled and the apparatus is stopped based on a determination that an error has occurred.

Even if a fault occurs in one of the two or more storage cassettes 31 which have been designated to store banknotes of the same denomination as described above, the depositing or dispensing process may still be performed by using another one of the storage cassettes 31 with no fault. Thus, this depositing/dispensing apparatus 1 replaces the storage cassette 31 causing a fault during the depositing or dispensing process with another storage cassette 31, if available, to continue the ongoing process. Further, in parallel with the ongoing process, a recovery operation is performed to restore the storage cassette 31 that has caused the fault. Next, it will be described what control is performed when a fault occurs during the depositing or dispensing process.

First, in this context, the fault refers herein to the one that occurs inside the storage cassette 31, and is resolvable through a recovery operation performed solely by the storage cassette 31 that has caused the fault. Specifically, a fault which may occur during the depositing process includes two kinds of faults, namely, a stacking failure and bridge. The stacking failure occurs in a stacking storage cassette 31, and refers to a phenomenon in which some of the banknotes are obliquely stacked on the stacking table 311 to form a gap between adjacent banknotes. Meanwhile, the bridge is a phenomenon in which some of the banknotes on the stacking table 311 overlap with each other just like a bridge between inner walls of the storage cassette 31.

These faults may be detected by a light sensor 34 and levers 35 provided in the storage cassette 31 as shown in FIG. 4.

The light sensor 34 includes a light emitter and a light receiver arranged such that their optical axes are coincident with each other, and is configured such that the light receiver receives light emitted from the light emitter. As shown in FIG. 4, the light sensor 34 has its optical axis extending obliquely from one side of the stacking table 311 in the lengthwise direction. The light from the light emitter is blocked when the number of banknotes stacked on the stacking table 311 increases to exceed a certain number. When the light sensor 34 detects that the light is blocked, the stacking table 311 moves down by a predetermined distance. In this way, an uppermost one of the banknotes stacked on the stacking table 311 may be maintained at substantially the same level. In FIG. 4, the banknotes are stacked on the stacking table 311 such that their longer edges are parallel to the direction coming out of the paper of FIG. 4. The light sensor 34 is arranged such that its optical axis is located around the longitudinal center of the banknotes.

Each of the levers 35 is inclined in a direction intersecting with the optical axis of the light sensor, and has an upper end pivotally supported and a lower end located on the stacking table 311. The levers 35 are respectively positioned near the shorter edges of the banknotes stacked on the stacking table 311. When brought into the storage cassette 31 and placed on the stacking table 311, the banknote pushes the levers 35 upward. Then, the levers 35 are placed on the banknote on the stacking table 311. A photointerrupter 351 is attached to a middle portion of each lever 35. The photointerrupter 351 detects that the lever 35 has been pushed up.

It may be determined that the stacking failure or bridge has occurred if the light of the light sensor 34 is kept blocked for a predetermined amount of time or longer, or if the light remains blocked even after the stacking table 311 is moved down in accordance with the fact that the light sensor 34 has detected the blocking of light, or if at least one of the two levers is kept pushed up.

The stacking failure, when occurring in the storage cassette 31, could sometimes be resolved by repeated up-and-down movement of the stacking table 311. The up-and-down movement of the stacking table 311 corresponds to the recovery operation for resolving the stacking failure.

Further, the bridge, when occurring in the storage cassette 31, could sometimes be resolved by a compression operation performed at least once, i.e., pressing of the banknotes stacked on the stacking table 311 onto the ceiling surface (not shown) of the storage cassette 31 by moving the stacking table 311 upward. The compression operation performed by the stacking table 311 corresponds to the recovery operation for resolving the bridge.

It may be determined, based on the results of detection of the light sensor 34 and the levers 35, whether or not the recovery operation thus performed has resolved the stacking failure or the bridge. The fault that could occur during the depositing process is not limited to a stacking failure or a bridge.

The faults that could occur during the depositing process, and the recovery operations for resolving such faults have been described above. During the dispensing process, a fault called a "feeding failure" could occur. The feeding failure means that the banknote fed from the stacking table 311 is skewed or bent. The feeding failure may be detected by light sensors 36 located halfway on a transport path extending in the storage cassette 31.

As per the light sensor 34 described above, each of the light sensors 36 also includes a light emitter and a light receiver arranged such that their optical axes are coincident with each other, and is configured such that the light receiver receives light emitted from the light emitter. The light sensors 36 are arranged such that their optical axes cross the banknote transport path, and are spaced apart from each other in the direction coming out of the paper of FIG. 4 (along the longer edges of the banknotes). The passage of the banknote can be detected when the light sensors 36 sequentially detect that the light is transmitted, blocked, and then transmitted again. If the plurality of light sensors 36 spaced apart from each other along the longer edges of the banknotes detect the transmission and blocking of light at significantly different times, it may be determined that the banknote is skewed. Further, if at least some of the light sensors 36 detect that the light is blocked for a significantly short time, it may be determined that the banknote is bent.

If a feeding failure has occurred in the storage cassette 31, a retry operation is performed to return the banknote once to the stacking table 311, and then feed the banknote again from the stacking table 311. The retry operation corresponds to the recovery operation for resolving the feeding failure.

It may also be determined, based on the detection results of the light sensors 36, whether or not the recovery operation has resolved the feeding failure. Note that the fault that could occur during the dispensing process is not limited to the feeding failure.

Referring to the flowchart shown in FIG. 13, it will be described how the controller 55 performs control when a fault occurs during the depositing or dispensing process. This flow starts when the depositing or dispensing process is started. In Step S1 after the start, a determination is made whether or not the depositing or dispensing process has been finished yet. The flow ends if the process has been finished. If the process has not been finished yet, the process proceeds to Step S2.

In Step S2, a determination is made whether or not the storage cassette 31 being used during the ongoing process has caused any fault. As described above, the controller 55 is able to determine, based on the detection results of the light sensors 34, 36 and the levers 35 provided for the storage cassette 31, whether any fault has occurred or not. If no faults have occurred, the process returns to Step S1 to continue the ongoing process as it is. On the other hand, if any fault has occurred, the process proceeds to Step S3.

In Step S3, a determination is made whether the ongoing process can be continued if the storage cassette 31 that has caused the fault is switched to a different storage cassette 31. As described above, the storage cassette 31 that has caused the fault can sometimes be switched to a different storage cassette 31 if two or more storage cassettes 31 are able to store banknotes of the same denomination, or a single storage cassette 31 (a mixed denomination storage cassette 31) is able to store banknotes of different denominations. If the switching is able, the process proceeds to Steps S41 and S42. On the other hand, if the switching is not able, the process proceeds to Step S5.

In Step S5, the ongoing process is suspended because it cannot be continued, and a recovery operation is performed in the next Step S6 to resolve the fault that has occurred. In Step S7, a determination is made whether or not the fault has been resolved by the recovery operation. If the fault has been resolved, the flow returns to Step S1 to resume the suspended process. On the other hand, if the fault has not been resolved, the process proceeds to Step S8, and the depositing/dispensing apparatus 1 is stopped based on a determination that an error has occurred. In this case, the authorized person draws the storage unit 3 out of the protective housing 131 to resolve the fault.

In contrast, if the switch of the storage cassettes 31 is able, the storage cassettes 31 are switched first in Step S41, and then the process returns to Step S1. Then, the depositing or dispensing process is continued using the storage cassette 31 newly selected. Meanwhile, in parallel with Step S41, a recovery operation is performed in Step S42 to restore the storage cassette 31 that has caused the fault. In Step S9, a determination is made whether the fault has been resolved or not. If the fault has been resolved, the process returns to Step S1. On the other hand, if the fault has not been resolved, the recovery operation is repeated in Step S42. Repeating the recovery operation increases the possibility of resolving the fault. In Step S42, sufficient time may be spent to perform the recovery operation because the depositing or dispensing process is continuously performed separately.

To start the next depositing or dispensing process while the recovery operation is being performed in Step S42, i.e., when the fault has not been resolved yet, the controller 55 disables the storage cassette 31 that has not recovered from the fault yet, and performs the depositing or dispensing process using another storage cassette 31 which has caused no fault. This allows the depositing or dispensing process to be done quickly, thus avoiding delay in business operations at a bank. Note that if the depositing or dispensing process cannot be performed when the storage cassette 31 that has not recovered from the fault is disabled, the depositing/dispensing apparatus 1 may be stopped at that time based on a determination that an error has occurred.

Figure 13:
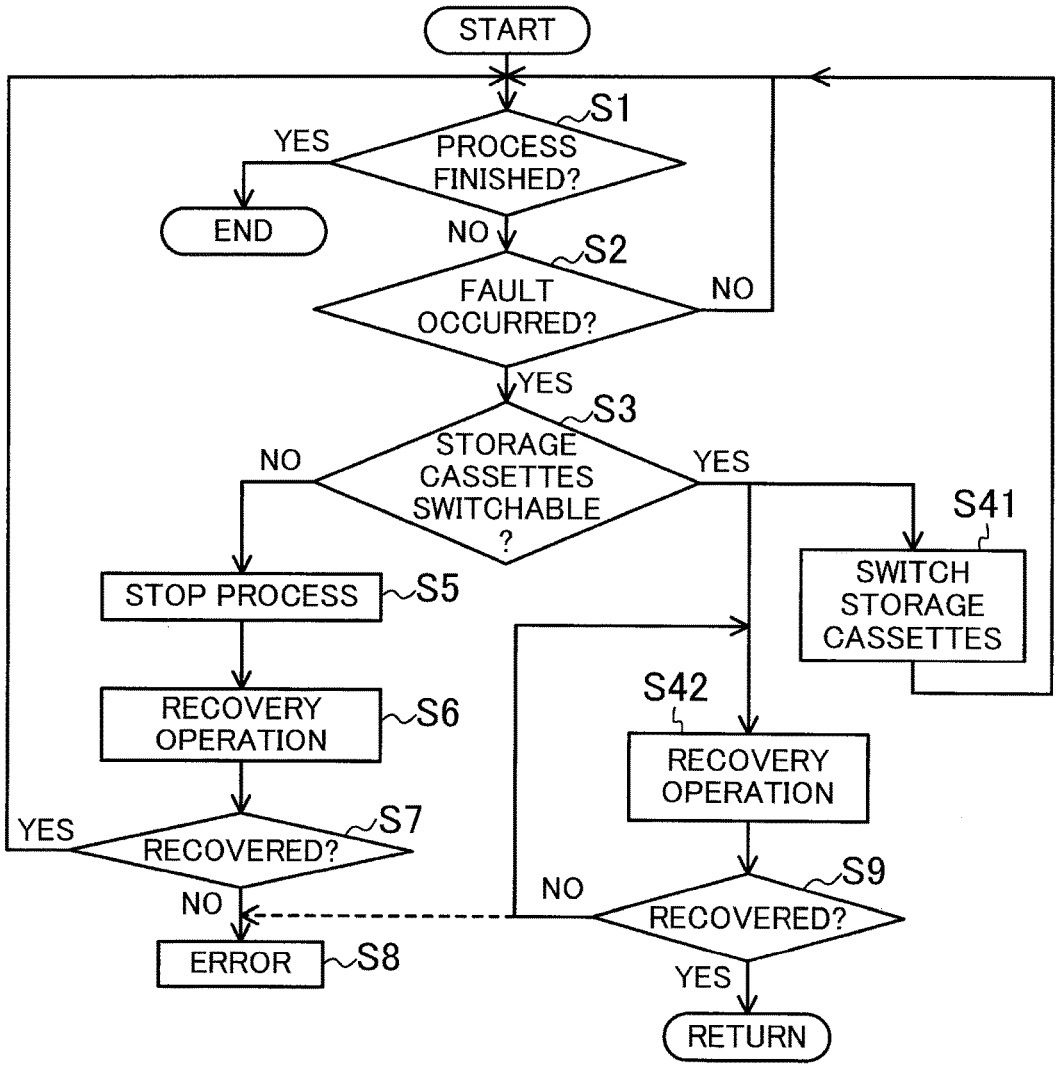
FIG. 13 is a flowchart illustrating how control is performed if a fault occurs during a depositing or dispensing process.

If the fault persists even after the recovery operation has been repeated a predetermined number of times in Step S42, the process proceeds to Step S8 as indicated by the broken line shown in FIG. 13, and the depositing/dispensing apparatus 1 may be stopped based on a determination that an error has occurred. Note that if the depositing/dispensing apparatus 1 is performing the depositing or dispensing process when the controller 55 is about to stop the depositing/dispensing apparatus 1 based on a determination that an error has occurred, it is not until the depositing or dispensing process is finished that the depositing/dispensing apparatus 1 may be stopped due to the error. Alternatively, the subsequent depositing and dispensing processes may be performed with the storage cassette 31 that has not recovered from the fault kept disabled due to the error.

As can be seen from the foregoing, if the storage cassette 31 has caused a fault during the depositing or dispensing process, the ongoing process is not suspended to perform the recovery operation, but is continued by using another storage cassette 31 in place of the storage cassette 31 that has caused the fault. This allows the ongoing process to be finished quickly.

The storage unit 3 of the above-described depositing/dispensing apparatus 1 is configured to be drawn only backward of the apparatus. Although not shown, a second opening may be formed in the front surface of the protective housing 131 so that the storage unit 3 can also be drawn forward of the apparatus through the second opening, not just backward. Likewise, the handling unit 11, which can be drawn only forward of the apparatus, may also be drawn backward of the apparatus through a second opening formed in the rear surface of the upper housing 111, not just forward.

Optionally, the depositing/dispensing apparatus 1 may be configured to be drawn not in the lengthwise direction, but in the widthwise direction. For example, the handling unit 11 may be configured to be drawn leftward or rightward of the apparatus, and the storage unit 3 may be configured to be drawn rightward or leftward of the apparatus.

The present disclosure is not limited to the banknote dispensing/depositing apparatus, and is broadly applicable to a variety of banknote handling apparatuses including an upper housing and a lower housing.

DESCRIPTION OF REFERENCE CHARACTERS

1 Banknote Depositing/Dispensing Apparatus (Banknote Handling Apparatus)
111 Upper Housing
1111 Opening
131 Protective Housing (Lower Housing)
1311 Opening
133 Barrier
3 Storage Unit
31 Storage Cassette (Storage Case)
41 Transport Unit
411 Loop Transport Path (Transport Path)
4141 Passage
42 Branch Mechanism
55 Controller

The invention claimed is:

1. A banknote handling apparatus, comprising:

a transport unit configured to transport banknotes;

a plurality of storage cases configured to store the banknotes;

an upper housing configured to house the transport unit;

a lower housing arranged under the upper housing, configured to house the plurality of storage cases, and including a barrier, the barrier being provided between the upper and lower housings to separate the lower housing from the inside of the upper housing; and a controller which is configured to perform at least one of a depositing process of storing the banknotes which have entered the upper housing in a predetermined one of the plurality of storage cases via the transport unit, or a dispensing process of dispensing the banknotes fed from the predetermined one of the plurality of storage cases out of the upper housing via the transport unit, wherein when one of the storage cases causes a fault during the depositing or dispensing process, the controller switches the storage case that has caused the fault to a different one of the storage cases to continue the process, while performing a recovery operation of restoring the storage case that has caused the fault.

2. The apparatus of claim 1, wherein the fault occurs inside the storage case, and is resolvable through the recovery operation performed solely by the storage case.

3. The apparatus of claim 1, wherein in a situation where the fault has been resolved through the recovery operation, the controller enables the storage case that has recovered from the fault when a next process is performed, and in a situation where the fault has not been resolved through the recovery operation, the controller disables the storage case that has not recovered from the fault when a next process is performed.

4. The apparatus of claim 1, wherein the storage case is a stacking storage case configured to store the banknotes in a stacked state.

* * * * *